US005156939A

United States Patent [19]

Koide

[11] Patent Number: 5,156,939

[45] Date of Patent: Oct. 20, 1992

[54] HEAT-DEVELOPABLE LIGHT-SENSITIVE MATERIAL

[75] Inventor: Tomoyuki Koide, Kanagawa, Japan

[73] Assignee: Fuji Photo Film Co., Ltd., Kanagawa, Japan

[21] Appl. No.: 742,498

[22] Filed: Aug. 5, 1991

Related U.S. Application Data

[63] Continuation of Ser. No. 375,782, Jul. 5, 1989.

[30] Foreign Application Priority Data

Jul. 5, 1988 [JP] Japan ..... 63-167044

[51] Int. Cl.[5] ..... G03K 5/54

[52] U.S. Cl. ..... 430/203; 430/223; 430/264; 430/607

[58] Field of Search ..... 430/203, 223, 264, 607

[56] References Cited

U.S. PATENT DOCUMENTS 4,237,214 12/1980 Mifune et al. ..... 430/264
4,783,396 11/1988 Nakamura et al. ..... 430/203
4,820,622 4/1989 Hirai ..... 430/203

FOREIGN PATENT DOCUMENTS 140340 7/1985 Japan .

*Primary Examiner*—Hoa Van Le
*Attorney, Agent, or Firm*—Sughrue, Mion, Zinn, Macpeak & Seas

[57] ABSTRACT

A heat-developable light-sensitive material is disclosed, comprising a support having thereon at least a surface latent image type silver halide, a binder, an electron transfer agent or a precursor thereof, an electron donor, a reducible dye providing compound capable of releasing a diffusible dye upon being reduced with the electron donor and a hydrazine derivative.

The heat-developable light-sensitive material can provide positive images having a sufficiently high image density and a low minimum density in a short period of developing time.

43 Claims, No Drawings

HEAT-DEVELOPABLE LIGHT-SENSITIVE MATERIAL

This is a continuation of application Ser. No. 07/375,782 filed Jul. 5, 1989, now allowed.

FIELD OF THE INVENTION

The present invention relates to a heat-developable light-sensitive material, more particularly, a heat-developable light-sensitive material which provides positive images having a sufficiently high image density and a low minimum density in an especially short period of developing time.

BACKGROUND OF THE INVENTION

Heat-developable light-sensitive materials are well known in the art. Examples of heat-developable light-sensitive materials and heat development processes are described, for example, in *Shashinkogaku no Kiso,* "Edition of Higin-en Shashin", pages 242 to 255 (Corona Co., Ltd., 1982) and U.S. Pat. No. 4,500,626.

With respect to processes for obtaining positive color images many methods have been produced. For instance, in U.S. Pat. No. 4,559,290, a method is described wherein an oxidized compound, which in its oxidized state does not have a dye releasing ability, obtained by converting a so-called DRR (dye releasing redox) compound, :s coexistent with a reducing agent, the reducing agent is oxidized by exposed silver halide upon heat development, and the oxidized compound is reduced with remaining reducing agent which is not oxidized, whereby a diffusible dye is released. Further, in European Patent 220,746A and Kokai Giho 87-6199 (Kokai Giho, Vol. 12, No. 22), a method of forming a heat-developable positive image using a novel compound which can release a diffusible dye in a similar mechanism is described.

However, the above described positive image forming methods are disadvantageous in that, while a portion of the reducing agent is oxidized upon the reduction of silver halide, the reducing agent which is not oxidized and remains at the exposed area in case of using a short period of developing time reduces the reducible dye providing compound to cause the increase in the minimum density.

SUMMARY OF THE INVENTION

Therefore, an object of the present invention is to provide a heat-developable light-sensitive material for forming a positive image having a sufficiently high image density and a low minimum density in a short period of developing time.

Other objects of the present invention will become apparent from the following detailed description and examples.

The above described objects of the present invention are accomplished with a heat-developable light-sensitive material comprising a support having thereon at least a surface latent image type silver halide, a binder, an electron transfer agent or a precursor thereof, an electron donor, a reducible dye providing compound capable of releasing a diffusible dye upon being reduced with the electron donor and a hydrazine derivative.

DETAILED DESCRIPTION OF THE INVENTION

As the hydrazine derivative used in the present invention, which functions as a thermal fogging preventing agtent, compounds represented by the general formula (I) described below are preferably used:

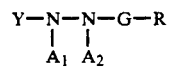

(I)

wherein Y represents an aliphatic group, an aromatic group or a heterocyclic group; $A_1$ and $A_2$ each represents a hydrogen atom or one of them represents a hydrogen atom and the other represents an alkylsulfonyl group, an arylsulfonyl group or

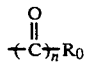

(wherein $R_0$ represents an alkyl group, an alkenyl group, an aryl group, an alkoxy group or an aryloxy group; and n represents 1 or 2); R represents a hydrogen atom, an alkyl group, an aralkyl group, an aryl group, an alkoxy group, an aryloxy group, an amino group, an alkoxycarbonyl group, an aryloxycarbonyl group, a carbamoyl group, an azo group or a heterocyclic group; and G represents a carbonyl group, a sulfonyl group, a sulfoxy group,

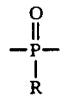

or an iminomethylene group; provided that G, $A_1$, $A_2$ and the hydrazine nitrogen atoms may form a hydrazone structure (>N—N=C<).

In the general formula (I) described above, the aliphatic group represented by Y is a straight chain, branched chain or cyclic alkyl group, alkenyl group or alkynyl group.

The aromatic group represented by Y includes a monocyclic or dicyclic aryl group such as a phenyl group and a naphthyl group.

The heterocyclic group represented by Y is a 3-membered to 10-membered, saturated or unsaturated heterocyclic group having at least one of N, O, and S, and the heterocyclic ring may be a single ring or form a condensed ring with an other aromatic ring or heterocyclic ring. The heterocyclic group represented by Y preferably includes a 5-membered or 6-membered aromatic heterocyclic group, for example, a pyridyl group, an imidazolyl group, a pyrimidyl group, a pyrazolyl group, an isoquinolinyl group, a thiazolyl group, and a benzothiazolyl group.

The group represented by Y may be substituted with one or more substituents selected from an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an aryloxycarbonyl group, an acyl group, an alkoxycarbonyl group, an acyloxy group, a carbonamido group, a sulfonamido group, and a nitro group, and these substituents may be further substituted.

The groups may combine with each other to form a ring.

Y is preferably an aromatic group and more preferably an aryl group.

The group represented by R is preferably as follows.

When G is a carbonyl group, R is preferably a hydrogen atom, an alkyl group (e.g., methyl, trifluoromethyl, 3-hydroxypropyl, and 3-methanesulfonamidopropyl), an aralkyl group (e.g., o-hydroxybenzyl), an aryl group (e.g., phenyl, 3,5-dichlorophenyl, o-methanesulfonamidophenyl, and 4-methanesulfonylphenyl), an alkoxy group (e.g., methoxy), an aryloxy group (e.g., phenoxy, p-nitrophenoxy, and p-chlorophenoxy), an amino group (e.g., methylamino, phenylamino, p-nitrophenylamino, and p-methoxyphenylamino), an alkoxycarbonyl group (e.g., ethoxycarbonyl), an aryloxycarbonyl group (e.g., phenoxycarbonyl), a carbamoyl group (e.g., unsubstituted carbamoyl and methylcarbamoyl), an azo group (e.g., phenylazo), or a heterocyclic group (e.g., a nitrogen-containing heterocyclic group such as pyridyl and quinolyl). In this case, R is particularly preferably a hydrogen atom.

When G is a sulfonyl group, R is preferably an alkyl group (e.g., methyl), an aralkyl group (e.g., o-hydroxyphenylmethyl), an aryl group (e.g., phenyl), or a substituted amino group (e.g., dimethylamino).

When G is a sulfoxy group, R is preferably a cyanobenzyl group or a methylthiobenzyl group.

When G is

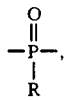

R is preferably a methoxy group, an ethoxy group, a butoxy group, a phenoxy group or a phenyl group, and particularly preferably a phenoxy group.

When G is an N-substituted or unsubstituted iminomethylene group, R is preferably a methyl group, an ethyl group or a substituted or unsubstituted phenyl group.

G is most preferably a carbonyl group.

The group represented by R may be substituted with one or more substituents selected from those as described for Y.

These substituents may be further substituted with the substituents as described for Y above and they may combine with each other to form a ring.

It is preferred that Y or R, particularly Y, contains a ballast group conventionally used for immobile photographic additives such as couplers. The ballast group is an organic group which gives a sufficient molecular weight to the compound represented by the general formula (I) so that the compound does not substantially diffuse into other layers, and comprises an alkyl group, an aryl group, a heterocyclic group, an ether group, a thioether group, an amido group, a ureido group, a urethane group, a sulfonamido group or a combination thereof. These groups may be substituted with one or more substituents selected from those as described for Y.

When Y or R contains a ballast group, the total number of carbon atoms included in Y and R is preferably 12 or more.

Further, Y or R may contain a group which accelerates the adsorption of the compound represented by the general formula (I) on the surface of silver halide grain and represented by the following formula:

$$X_0—L_0)_{m0}$$

wherein $X_0$ represents an adsorption accelerating group for silver halide; $L_0$ represents a divalent linkage group; and $m_0$ represents 0 or 1.

Preferred examples of the adsorption accelerating group for silver halide represented by $X_0$ include a thioamido group, a mercapto group, a group having a disulfide bond or a 5-membered or 6-membered nitrogen-containing heterocyclic group.

The thioamido adsorption accelerating group represented by $X_0$ is a divalent group represented by the formula

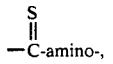

which may be a part of a ring structure or a noncyclic thioamido group.

Suitable thioamido groups are described in, for example, U.S. Pat. Nos. 4,030,925, 4,031,127, 4,080,207, 4,254,037, 4,255,511, 4,266,013, and 4,276,364, and *Research Disclosure,* Vol. 151, No. 15162 (Nov. 1976) and ibid., Vol. 176, No. 17626 (December 1978).

Suitable examples of the noncyclic thioamido group include a thioureido group, a thiourethane group, and a dithiocarbamic acid ester and suitable examples of the cyclic thioamido group include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4 oxadiazoline-2-thione, benzimidazoline-2-thione, benzoxazoline-2-thione, and benzothiazoline-2-thione. These groups may be further substituted.

As the marcapto group represented by $X_0$, examples include an aliphatic mercapto group, an aromatic mercapto group and a heterocyclic mercapto group (when the atom adjacent to the carbon atom bonded to the —SH group is a nitrogen atom, the group is the same as a cyclic thioamido group which is a tautomer thereof, and examples of the group are the same as those illustrated above).

As the 5-membered or 6-membered nitrogen-containing heterocyclic group represented by $X_0$, there are 5- or 6-membered nitrogen-containing heterocyclic rings composed of a combination of nitrogen, oxygen, sulfur and carbon. Preferred examples of the group include benzotriazole, triazole, tetrazole, indazole, benzimidazole, imidazole, benzothiazole, thiazole, benzoxazole, oxazole, thiadiazole, oxadiazole, and triazine. These groups may be further substituted with one or more appropriate substituents such as those illustrated above for Y.

The divalent linkage group represented by $L_o$ is an atom selected from C, N, S, and O or an atomic group having at least one of C, N, S, and O. Specific examples of $L_o$ include an alkylene group, an alkenylene group, an alkynylene group, an arylene group, —O—, —S—, —NH—, —CO—, —$SO_2$— (they may have a substituent) or a combination thereof.

In the general formula (I) described above, $A_1$ and $A_2$ each represents a hydrogen atom, an alkylsulfonyl or arylsulfonyl group having at most 20 carbon atoms (preferably a phenylsulfonyl group or a phenylsulfonyl group substituted such that the sum of the Hammett's substituent constants is at least −0.5), or $$\left(\overset{O}{\overset{\|}{C}}\right)_n R_0$$

(wherein $R_0$ represents a straight chain, branched chain or cyclic alkyl group or alkenyl group preferably having at most 30 carbon atoms, an aryl group (preferably a phenyl group or a phenyl group substituted such that the Summ of the Hamett's substituent constants is at least −0.5), an alkoxy group (e.g., methoxy), or an aryloxy group (preferably a monocyclic aryloxy group). These groups may be substituted with one or more substituents such as those illustrated above for Y.

$A_1$ and $A_2$ are most preferably hydrogen atoms.

Of the compounds represented by the general formula (I), those represented by the general formula (II) shown below are preferred.

$$(Y_1-L_2)_l L_1-\overset{A_1}{\overset{|}{N}}-\overset{A_2}{\overset{|}{N}}-G-R \qquad \text{(II)}$$

wherein $A_1$, $A_2$, G and R each has the same meaning as defined in the general formula (I); $L_1$ represents an arylene group; $L_2$ represents a divalent linkage group; $Y_1$ represents an aliphatic group or an aromatic group; l represents an integer from 0 to 3; and the total number of carbon atoms included in R, $L_1$, $L_2$ and $Y_1$ is at least 12.

The arylene group represented by $L_1$ is preferably a phenylene group or a naphthylene group, and particularly preferably a phenylene group. $L_1$ may have one or more substituents other than $Y_1$—$L_2$—. Such substituents include those illustrated for Y in the general formula (I).

The divalent linkage group represented by $L_2$ is an atom selected from C, N, S and O or an atomic group having at least one of C, N, S and O. Suitable examples of $L_2$ include an alkenylene group, an alkenylene group, an alkynylene group, an arylene group, —O—, —S—, $$-\underset{\underset{R_{00}}{|}}{N}-$$

(wherein $R_{00}$ represents a hydrogen atom, a straight chain, branched chain or cyclic, substituted or unsubstituted alkyl group having at most 30 carbon atoms or a substituted or unsubstituted phenyl or naphthyl group having at most 30 carbon atoms), —CO—, —$SO_2$— or a combination thereof. Specific examples of $L_2$ are set forth below.

$-CH_2-$, $(CH_2)_2$, $(CH_2)_3$, 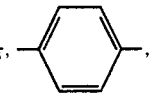 ,

-continued

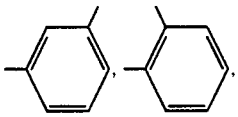 , —CONH—, —OCONH—,

—NHCONH—, —SCONH—, —$SO_2$NH—,

—NH$SO_2$NH—, —COO—,

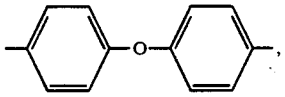 ,

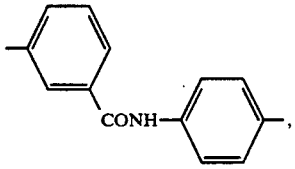 ,

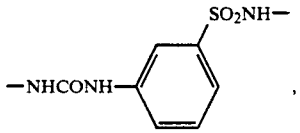 ,

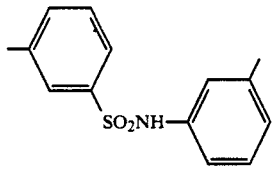 ,

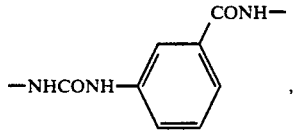 ,

—CONH$CH_2CH_2$CONH—, —$CH_2CH_2SO_2$NH—,

—$CH_2CH_2$—O—$CH_2CH_2$—, —$CH_2CH_2$NHCONH—, and

—$CH_2CH_2$—CONH—.

These groups may be substituted with one or more substituents such as those illustrated for Y in the general formula (I).

The aliphatic group represented by $Y_1$ include a Substituted or unsubstituted, straight chain, branched chain or cyclic alkyl group, alkenyl group or alkynyl group having at most 70 carbon atoms, preferably at most 30 carbon atoms, and more preferably a branched chain or cyclic alkyl group.

The aromatic group represented by $Y_1$ is preferably a substituted or unsubstituted aryl group having from 6 to 70 carbon atoms.

The substituents for the aliphatic group or aromatic group represented by $Y_1$ include those illustrated for Y in the general formula (I).

When l represents 2 or 3, the $Y_1$—$L_2$—s' may be the same or different.

l is preferably 1 or 2.

The total number of carbon atoms included in R, $L_1$, $L_2$ and $Y_1$ is preferably from 12 to 70. It is more preferred that the total number of carbon atoms included in $L_1$, $L_2$ and $Y_1$ is from 12 to 70.
Specific examples of the compound represented by the general formula (I) are set forth below, but the present invention should not construed as being limited thereto.
(1)
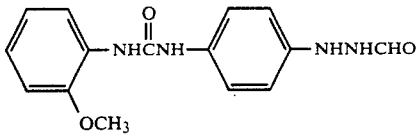
(2)
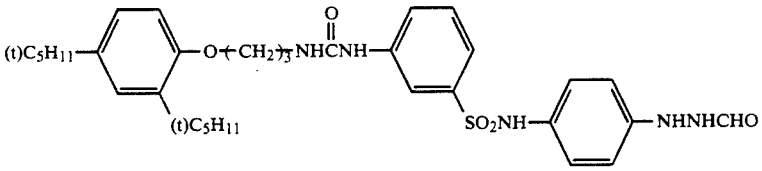
(3)
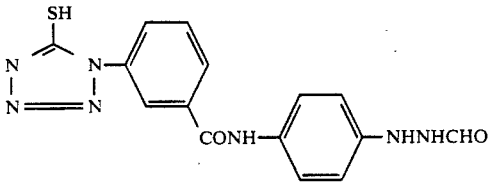
(4)
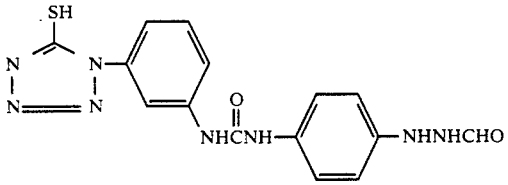
(5)
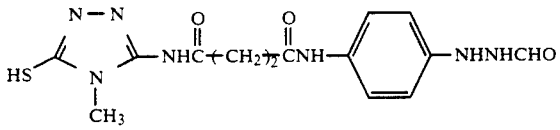
(6)
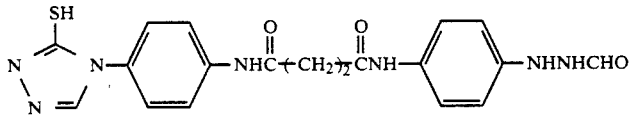
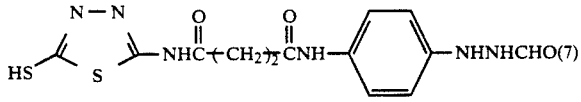
(7)
(8)
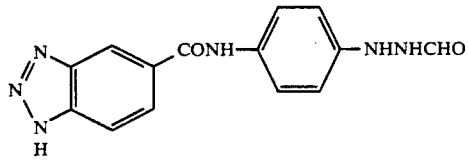
(9)
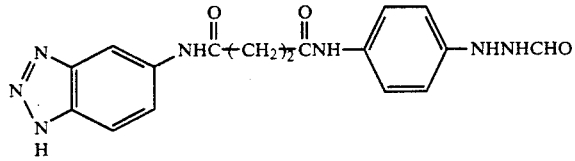

-continued

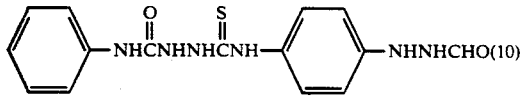

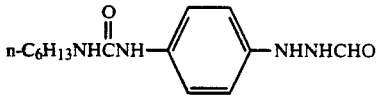

(11)

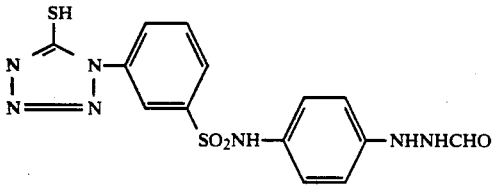

(12)

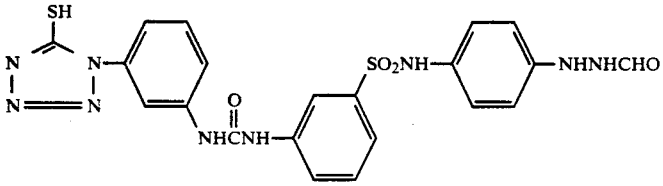

(13)

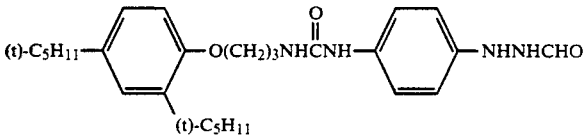

(14)

The hydrazine derivatives described above are known compounds and can be easily synthesized according to known methods.

The hydrazine derivatives according to the present invention can be employed individually or in a combination of two or more thereof.

The hydrazine derivative may be incorporated into any layer of the heat-developable light-sensitive material (hereinafter, sometime simply referred to as a light-sensitive material), but preferably a light-sensitive layer or an adjacent layer thereto (for example, an interlayer, or a protective layer), particularly preferably a light-sensitive layer.

The molar amount of the hydrazine derivative added is usually in a range from $1\times10^{-9}$ to $1\times10^{-3}$ mol, preferably in a range from $1\times10^{-8}$ to $1\times10^{-4}$ mol, per mol of surface latent image type silver halide.

When the hydrazine derivative according to the present invention is employed to a too much extent, the maximum density tends to decrease. However, the addition of the compound in the range described above can control the maintenance of the minimum density in a low level without a decrease in the image density.

In accordance with the present invention, the reducible dye providing compound is associated with a binder and a silver halide emulsion together with the electron transfer agent and the electron donor to form a light-sensitive layer unit. The reducible dye providing compound can be added to a layer containing a silver halide emulsion or separately to a layer adjacent thereto. In the latter case, the layer containing the reducible dye providing compound is preferably positioned under the silver halide emulsion layer from the standpoint of sensitivity. In such a case, the electron transfer agent and the electron donor can be added to any of the silver halide emulsion layer and the layer containing the reducible dye providing compound, however, it is preferred that at least the electron transfer agent is added to the silver halide emulsion layer.

According to one embodiment of the present invention, at least two groups of the light-sensitive layer unit as described above are employed. In order to reproduce full color, three groups of light-sensitive layer having different spectral sensitivities from each other are ordinarily provided. For example, a combination of a blue-sensitive layer, a green-sensitive layer and a red-sensitive layer, and a combination of a green-sensitive layer, red-sensitive layer and an infrared-sensitive layer are illustrated. These light-sensitive layers are positioned according to various orders known with conventional type color light-sensitive materials. Further, each of these light-sensitive layers may be divided into two or more layers, if desired.

Now, the reducible dye providing compound which can be used in the present invention will be described in detail below.

The reducible dye providing compound used in the present invention is preferably a compound represented by the following general formula (C-I):

$$\text{PWR—Time})_t\text{Dye} \qquad \text{(C-I)}$$

wherein PWR represents a group capable of releasing —Time)$_t$ Dye upon being reduced; Time represents a group capable of releasing Dye via a subsequent reaction after —Time)$_t$ Dye being released from PWR; t represents of 0 or 1; and Dye represents a dye or a precursor thereof.

Now, PWR in the general formula (C-I) will be described in greater detail below.

In the general formula (C-I), PWR may be a group containing an electron acceptive center and an intramolecular nucleophilic displacement reaction center in a compound capable of releasing a photographic reagent upon a nucleophilic displacement reaction in the molecule after being reduced as described, for example, in U.S. Pat. Nos. 4,139,389, 4,139,379 and 4,564,577, JP-A-59-185333 and JP-A-57-84453 (the term "JP-A" as herein means an "unexamined published Japanese patent application"); or may be a group containing an electron acceptive quinoid center in a compound capable of releasing a photographic reagent upon an intramolecular electron transfer reaction after being reduced and a carbon atom bonding the quinoid center and the photographic reagent as described, for example, in U.S. Pat. No. 4,232,107, JP-A-59-101649, Research Disclosure, No. 24025 (1984), and JP-A-61-88257. Also, PWR in the general formula (C-I) may be a group containing an aryl group substituted with an electron attractive group in a compound capable of releasing a photographic reagent by cleaving the single bond after being reduced and an atom (sulfur atom, carbon atoms, or nitrogen atom) bonding the aryl group and the photographic reagent as described, for example, in JP-A-56-142530, and U.S. Pat. Nos. 4,343,893 and 4,619,884.

Furthermore, PWR in the general formula (C-I) may be a group containing a nitro group in a nitro compound capable of releasing a photographic reagent after receiving an electron, and a carbon atom bonding the nitro group and the photographic reagent as described, for example, in U.S. Pat. No. 4,450,223; or may be a group containing a dieminaldinitro moiety in a dinitro compound capable of $\beta$-releasing a photographic reagent after receiving an electron, and a carbon atom bonding the dieminaldinitro moiety and the photographic reagent as described, for example, in U.S. Pat. No. 4,609,610.

Moreover, a compound containing a bond of $SO_2$—X wherein X represents oxygen atom, sulfur atom or nitrogen atom) and an electron attractive group in its molecule as described, for example, in U.S. Pat. No. Application Serial No. 188,779 filed on Apr. 29, 1988, a compound containing a bond of PO—X (wherein X has the same meaning as described above) and an electron attractive group in its molecule as described, for example, in JP-A-63-271344, and a compound containing a bond of C—X' (wherein X' represents oxygen atom, sulfur atom, nitrogen atom or —$SO_2$—) and an electron attractive group in its molecule as described, for example, in JP-A-63-271341 are also illustrated.

In order to more fully achieve the objects of the present invention, it is preferred to use a compound represented by the general formula (C-II) described below among the compounds represented by the general formula (C-I).

(C-II)

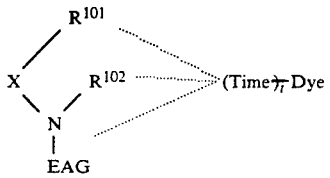

wherein

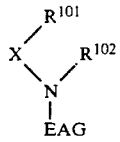

corresponds to PWR in the general formula (C-I); X represents an oxygen atom (—O—), a sulfur atom (—S—) or a nitrogen-containing group (—$NR^{103}$—); EAG represents a group capable of receiving an electron from a reducing substance; $R^{101}$, $R^{102}$ and $R^{103}$ each represents a simple bond or a group other than a hydrogen atom, or $R^{101}$, $R^{102}$ and $R^{103}$ may combine with each other to form a 5-membered to 8-membered ring; $(Time)_t$ Dye is bonded to at least one of $R^{101}$, $R^{102}$ or EAG; and Time, t and Dye each has the same meaning as defined in the general formula (C-I).

Suitable examples of the group other than a hydrogen atom represented by $R^{101}$, $R^{102}$ or $R^{103}$ include an alkyl group, an aralkyl group, an alkenyl group, an alkynyl group, an aryl group, a heterocyclic group, an acyl group, a sulfonyl group, a carbamoyl group and a sulfamoyl group. These groups may have one or more substituents.

$R^{101}$ and $R^{103}$ each preferably represents a substituted or unsubstituted alkyl group, alkenyl group, alkynyl group, aryl group, heterocyclic group, acyl group or sulfonyl group. The total number of carbon atoms included in each of $R^{101}$ and $R^{103}$ is preferably from 1 to 40.

$R^{102}$ preferably represents a substituted or unsubstituted acyl group or sulfonyl group. The total number of carbon atoms included in $R^{102}$ is preferably from 1 to 40.

X is particularly preferably an oxygen atom.

EAG is described in more detail below.

Among the compounds represented by the general formula (C-II), these represented by the general formula (C-III) described below are preferably employed in order to achieve the objects of the present invention.

(C-III)

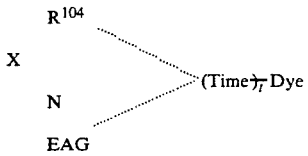

wherein $(Time)_t$ Dye is bonded to at least one of $R^{104}$ and EAG; X, EAG, Time, t and Dye each has the same meaning as defined in the general formula (C-II); and $R^{104}$ represents an atomic group bonded to X and the nitrogen atom necessary to form a 5-membered to 8-membered monocyclic or condensed heterocyclic ring together with X and the nitrogen atom.

As described above, EAG is a group capable of receiving an electron from a reducing substance and is bonded to the nitrogen atom of the compound.

The group represented by EAG is preferably a group represented by the following general formula (A):

(A)

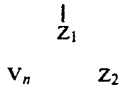

wherein $Z_1$ represents

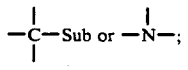

Vn represents an atomic group necessary to form a 3-membered to 8-membered aromatic ring together with $Z_1$ and $Z_2$; n represents an integer from 3 to 8; $V_n$ means the following:

$V_3$: $-Z_3-$, $V_4$: $-Z_3-Z_4-$, $V_5$: $-Z_3-Z_4-Z_4-$, $V_6$: $-Z_3-Z_4-Z_5-Z_6-$, $V_7$: $-Z_3-Z_4-Z_5-Z_6-Z_7$13 , and $V_8$: $-Z_3-Z_4-Z_5-Z_6-Z_7-Z_8-$; $Z_2$ to $Z_8$ each represents

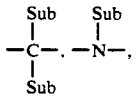

—O—, —S— or $-SO_2-$; and Sub represents a simple bond ($\pi$ bond), a hydrogen atom or a substituent described below. Plural Sub groups may be the same of different and may be linked to form a 3-membered to 8-membered saturated or unsaturated carbon ring or heterocyclic ring.

In the general formula (A), the Sub groups are selected such that the total of the Hammett's substituent constants $\rho\sigma$ of the Sub groups is preferably at least +0.50, more preferably at least +0.70, and most preferably at least +0.85.

EAG is preferably an aryl group or a heterocyclic group, each group being substituted with at least one electron attractive group.

The substituent for the aryl group or heterocyclic group, represented by EAG can be utilized for controlling the properties of the compound of the general formula (C-II) or (C-III). For example, the substituent for EAG can be utilized for controlling the electronegativity of the compound as well as controlling other properties for the compound, such as water-solubility, oil-solubility, diffusibility, sublimatibility, melting point, dispersibility in a binder such as gelatin, reactivity for a nucleophilic group, and reactivity for an electrophilic group.

Specific examples of EAG are described, for example, in European Patent 220,746A2, pages 6 to 7.

In the above described general formulae, Time represents a group capable of releasing Dye through a subsequent reaction, with the cleavage of a nitrogen-oxygen bond, a nitrogen-nitrogen bond or a nitrogen-sulfur bond as a trigger.

Various kinds of groups represented by Time are known and described, for example, in U.S. Pat. No. 4,783,396, columns 10 to 19.

In the above described general formulae, the dye represented by Dye includes, for example, an azo dye, an azomethine dye, an anthraquinone dye, a naphthoquinone dye, a styryl dye, a nitro dye, a quinoline dye, a carbonyl dye, and a phthalocyanine dye. Further, these dyes may be employed in the form temporarily shifted to a shorter wavelength region which is capable of recoloration during development processing.

Specific examples of Dye which can be used in the present invention are described, for example, in European Patent 76,492A and JP-A-59-165054.

The compound represented by the general formula (C-II) or (C-III) described above is preferably immobile itself in the photographic layer. Therefore, it is preferred to contain a ballast group having at least 8 carbon atoms in the group represented by EAG, $R^{101}$, $R^{102}$, $R^{104}$ or X, particularly in the group represented by EAG.

Representative examples of the reducible dye providing compounds which can be used in the present invention are specifically illustrated below, but the present invention is not to be construed as being limited thereto.

In addition, the dye providing compounds as described in European Patent 220,746A2 and Kokai Giho 87-6199 can also be employed.

(D-1)

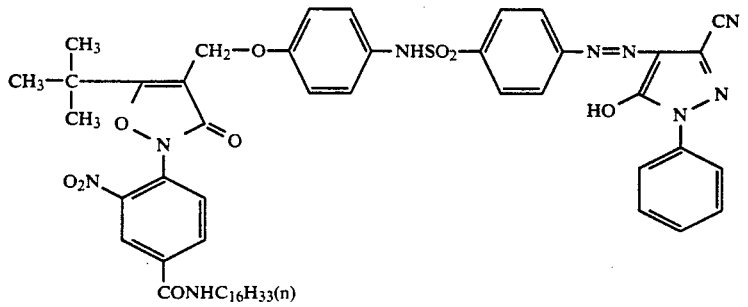

-continued
(D-2)
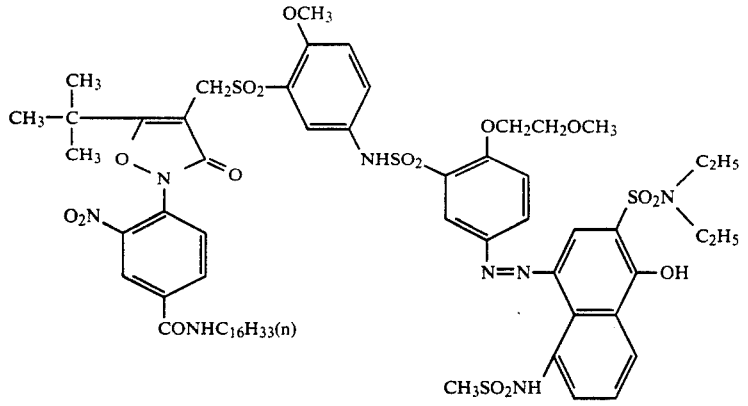
(D-3)
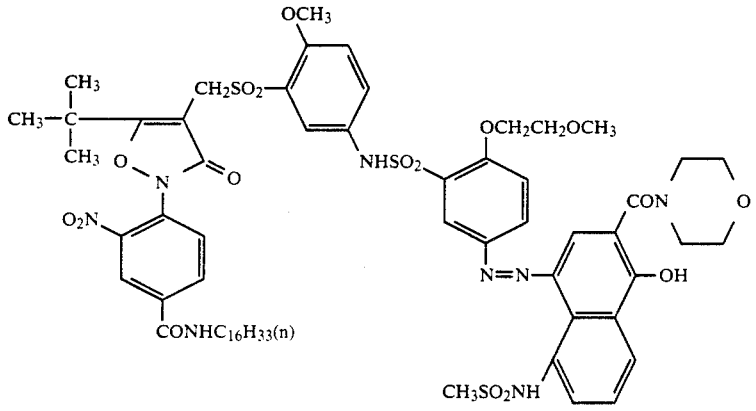
(D-4)
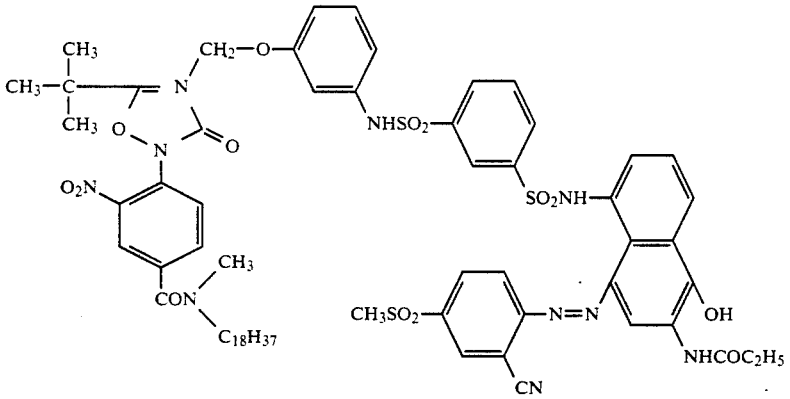
(D-5)
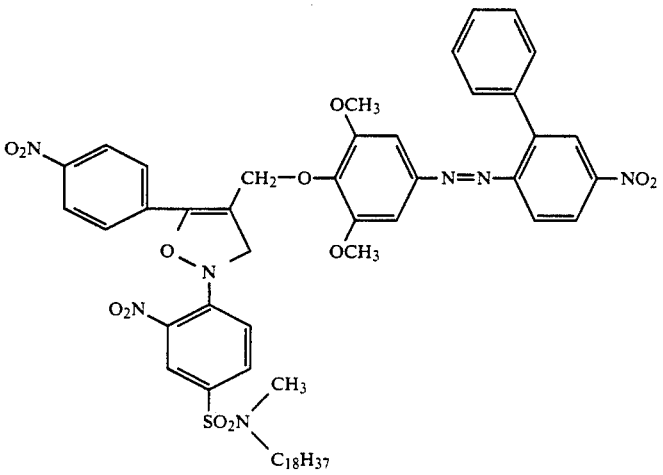

-continued
(D-6)
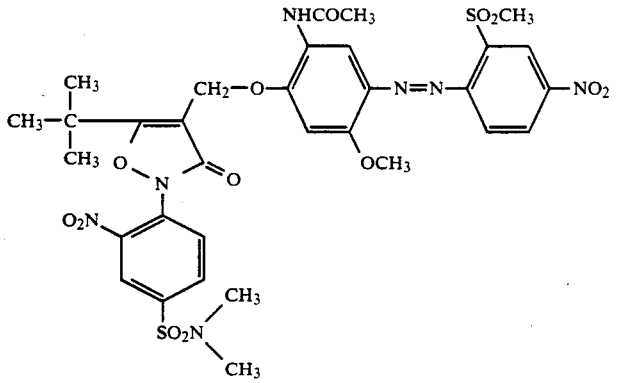
(D-7)
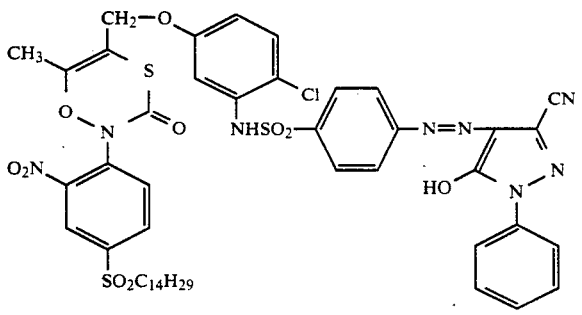
(D-8)
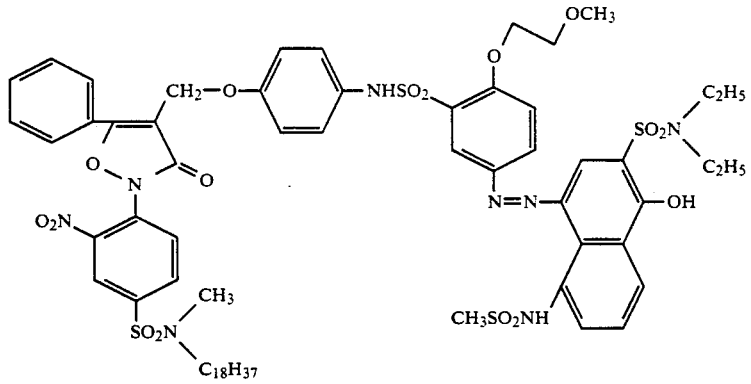
(D-9)
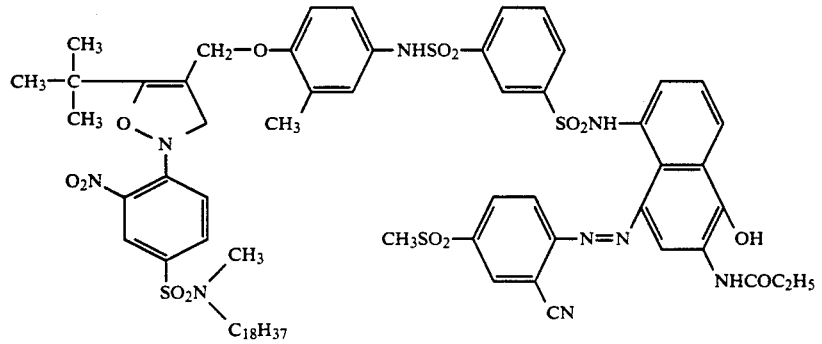

-continued
(D-10)
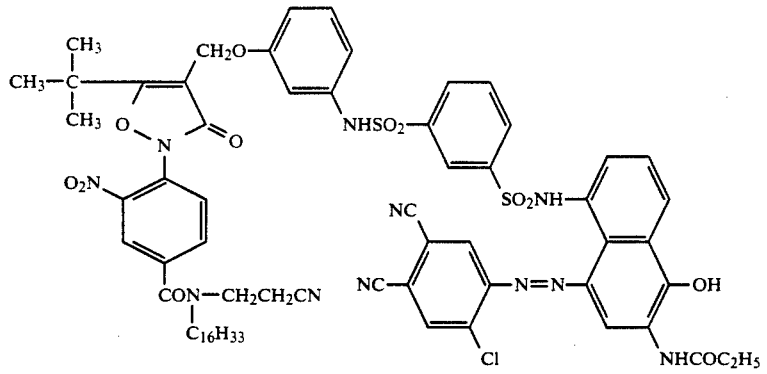
(D-11)
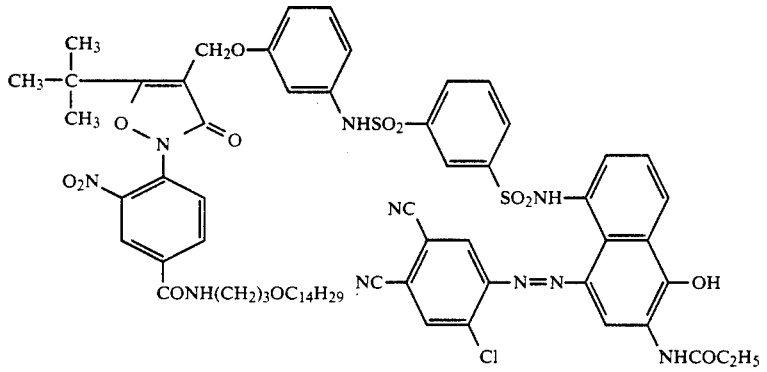
(D-12)
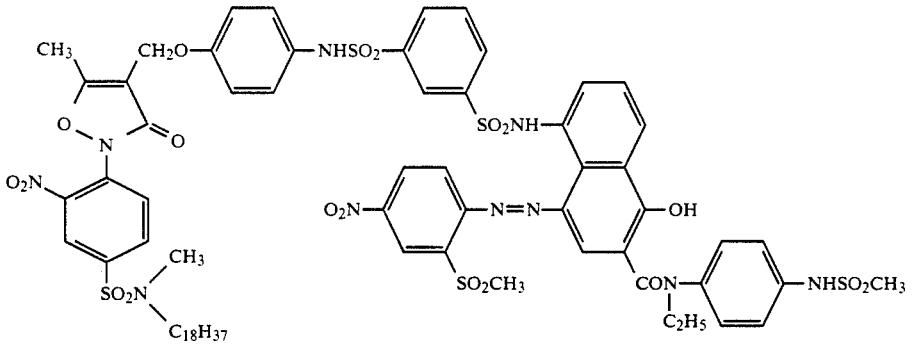
(D-13)
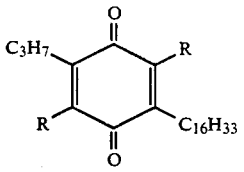
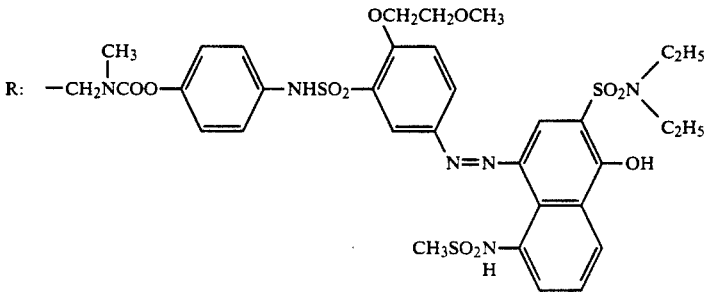

-continued (D-14)

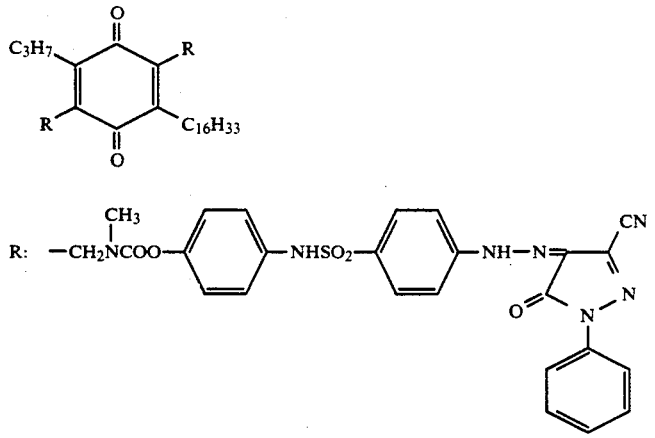

(D-15)

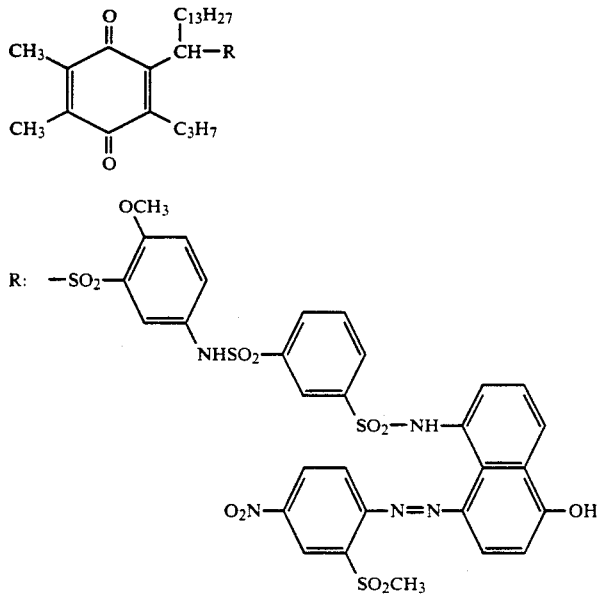

These compounds can be synthesized according to the methods as described in the patent specifications referred to above.

The amount of the dye releasing compound used is varied depending on the absorption coefficient thereof, but is generally in a range from 0.05 to 5 mmol/m$^2$, preferably in a range from 0.1 to 3 mmol/m$^2$.

The reducible dye providing compound according to the present invention can be employed individually or in a combination of two or more thereof. Further, in order to obtain a black image or different hue images, two or more kinds of dye providing compounds capable of releasing mobile dyes having different hues may be used together. For example, at least one of each cyan, magenta and yellow dye providing compounds may be incorporated in a mixture into a layer containing silver halide or a layer adjacent thereto as described in JP-A-60-162251.

In the present invention, the electron donor and the electron transfer agents (ETA) are employed as described above. These compounds are known in the art and described in greater detail, for example, in European Patent 220,746A2 and Kokai Giho 87-6199.

Particularly preferred electron donors or precursors thereof used include compounds represented by the following general formula (C) or (D):

(C)

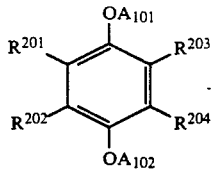

(D)

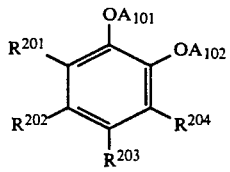

wherein $A_{101}$ and $A_{102}$, which may be the same or different, each represents a hydrogen atom or a protective group for a phenolic hydroxyl group, which is capable of being removed upon a nucleophilic reagent, or $A_{101}$ or $A_{102}$ may combine with $R^{201}$, $R^{202}$, $R^{203}$ or $R^{204}$ to form a ring; and $R^{201}$, $R^{202}$, $R^{203}$ and $R^{204}$, which may be the same or different, each represents a hydrogen atom, an alkyl group, an aryl group, an alkylthio group, an arylthio group, a sulfonyl group, a sulfo group, a halogen atom, a cyano group, a carbamoyl group, a sulfamoyl group, an amido group, an imido group, a carboxyl group, or a sulfonamido group, provided that the total number of carbon atoms included in $R^{201}$ to $R^{204}$ is at least 8, or $R^{201}$ and $R^{202}$ and/or $R^{203}$ and $R^{204}$ in the general formula (C), or $R^{201}$ and $R^{202}$, $R^{202}$ and $R^{203}$ and/or $R^{203}$ and $R^{204}$ in the general formula (D) may combine each other to form a saturated or unsaturated ring.

The nucleophilic reagent described abcve includes an anionic reagent, for example $OH^{\ominus}$, $RO^{\ominus}$(wherein R represents an alkyl group or an aryl group), a hydroxamic acid anion and $SO_3^{2\ominus}$and a compound having a non-covalent electron pair, for example, a primary or secondary amine, a hydrazine, a hydroxylamine, an alcohol, and a thiol.

Preferred examples of $A_{101}$ and $A_{102}$ include a hydrogen atom, an acyl group, an alkylsulfonyl group, an arylsulfonyl group, an alkoxycarbonyl group, an aryloxycarbonyl group, a dialkylphosphoryl group or a diarylphosphoryl group. Further, the protective groups as described in JP-A-59-197037 and JP-A-59-20105 are also preferably used.

The groups represented by $R^{201}$, $R^{202}$, $R^{203}$ or $R^{204}$ may have one or more substituents.

Of the electron donors represented by the general formula (C) or (D) described above, those wherein at least two of $R^{201}$ to $R^{204}$ are the substituents other than hydrogen atom are preferred. Further, compounds wherein at least one of $R^{201}$ and $R^{202}$, and at least one of $R^{203}$ and $R^{204}$ are the substituents other than hydrogen atoms are particularly preferred.

Two or more of the electron donors may be used in combination and an electron donor and a precursor of an electron donor may be used in combination. Further, the electron donor used may be the same compound as the reducing substance used in the present invention.

Specific examples of the electron donors used in the present invention are set forth below, but the present invention should not be construed as being limited thereto.

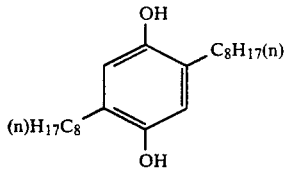
(ED-1)

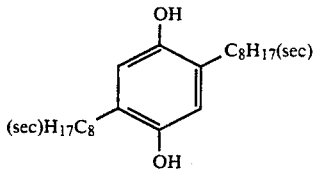
(ED-2)

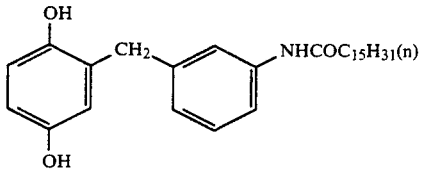
(ED-3)

-continued

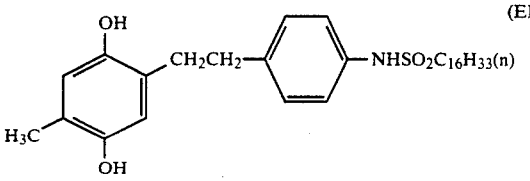
(ED-4)

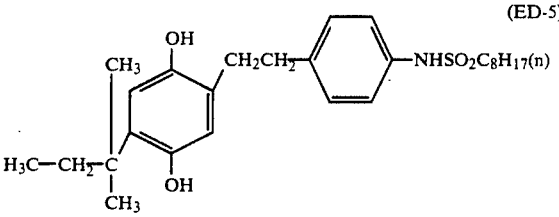
(ED-5)

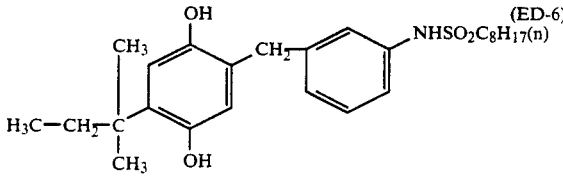
(ED-6)

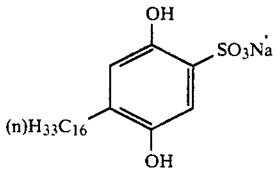
(ED-7)

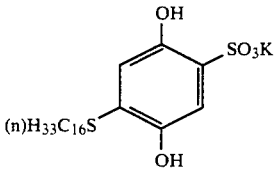
(ED-8)

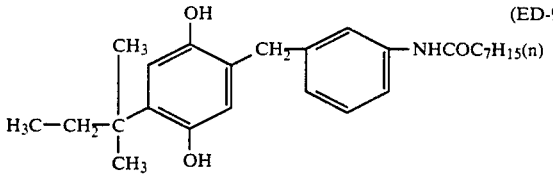
(ED-9)

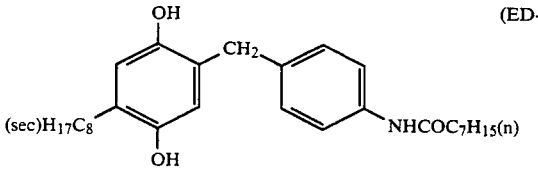
(ED-10)

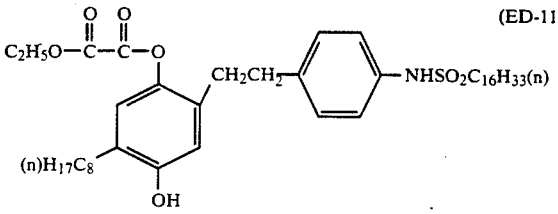
(ED-11)

-continued (ED-12)

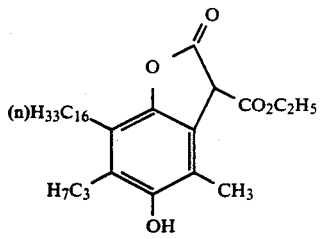

While the electron donor (or precursor thereof) can be employed in a wide range, it is preferred to use in a range form 0.01 to 50 mol, particularly from 0.1 to 5 mol, per mol of the positive dye providing compound. Further, it is used in a range from 0.001 to 5 mol, preferably from 0.01 to 1.5 mol, per mol of silver halide.

The electron transfer agent (ETA) used together with the electron donor is any compound which is oxidized by silver halide and the oxidation product thereof has an ability of cross-oxidizing the electron donor, and preferably a mobile compound.

Particularly preferred electron transfer agents used include compounds represented by the following general formula (X-I) or (X-II):

(X-I)

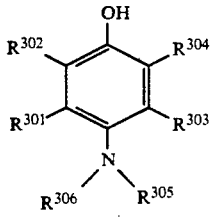

(X-II)

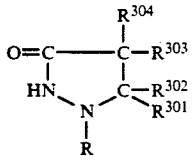

wherein $R_b$ represents an aryl group; and $R^{301}$, $R^{302}$, $R^{303}$, $R^{304}$, $R^{305}$ and $R^{306}$, which may be the same or different, each represents a hydrogen atom, a halogen atom, an acylamino group, an alkoxy group, an alkylthio group, an alkyl group or an aryl group.

The group represented by $R_b$, $R^{301}$, $R^{302}$, $R^{303}$, $R^{304}$, $R^{305}$ or $R^{306}$ may be substituted.

In the present invention, the compounds represented by the general formula (X-II) are particularly preferred. In the general formula (X-II), $R^{301}$, $R^{302}$, $R^{303}$ and $R^{304}$ each preferably represents a hydrogen atom, an alkyl group having from 1 to 10 carbon atoms, a substituted alkyl group having from 1 to 10 carbon atoms or a substituted or unsubstituted aryl group, and more preferably represents a hydrogen atom, a methyl group, a hydroxymethyl group, a phenyl group or a phenyl group substituted with a hydrophilic group, for example, a hydroxyl group, an alkoxy group, a sulfo group, or a carboxyl group.

Specific examples of ETA are set forth below, but the present invention should not be construed as being limited thereto.

(X-1)

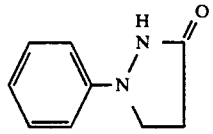

(X-2)

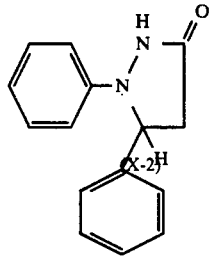

(X-3)

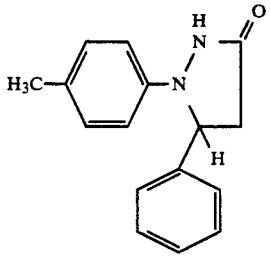

(X-4)

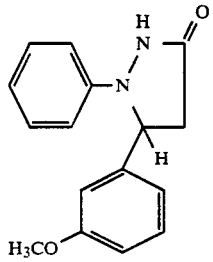

(X-5)

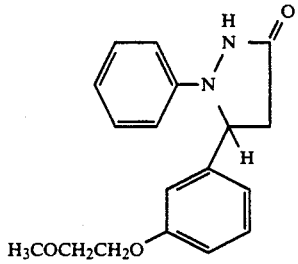

(X-6)

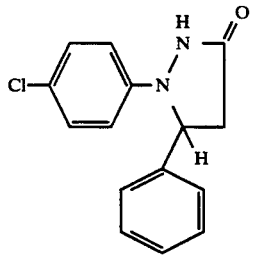

(X-7)

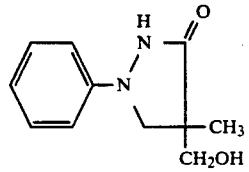

-continued (X-8)

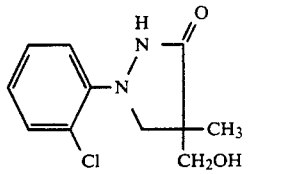

(X-9)

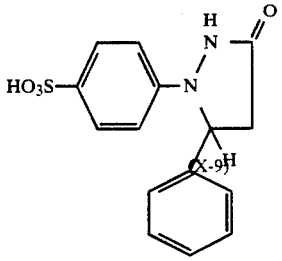

(X-10)

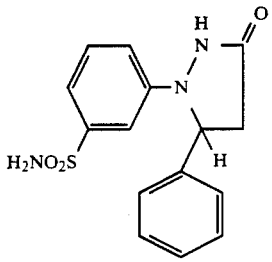

The precursor of the electron transfer agent which can be used in the present invention is a compound that does not exhibit a developing function during storage, i.e., before the use of the light-sensitive material, but is capable of releasing an electron transfer agent by the action of an appropriate activator for example, bases or nucleating agents or upon heating.

In particular, electron transfer agent precursors to be used in the present invention have a reactive functional group thereof blocked with a blocking group so that they do not function as electron transfer agents before development but are activated as electron transfer agents upon cleavage of the blocking group under alkaline conditions or when heated. Such electron transfer agent precursors used in the present invention include, for example, 2- and 3-acyl derivatives or 2-aminoalkyl- or hydroxyalkyl derivatives of 1-phenyl-3-pyrazolidinone, metal salts of hydroquinone, or catechol (e.g., salts with lead, cadmium, calcium or barium), halogenated acyl derivatives of hydroquinone, oxazine or bisoxazine derivatives of hydroquinone, lactone type electron transfer agent precursors, hydroquinone precursors having a quaternary ammonium group, cyclohex-2-ene-1,4-dione compounds as well as compounds capable of releasing an electron transfer agent on electron transfer, compounds capable of releasing an electron transfer agent on intramolecular nucleophilic displacement reaction, electron transfer agent precursors in which the reactive functional group is blocked with a phthalide group, and electron transfer agent precursors in which the reactive functional group is blocked with an indomethyl group.

These precursors are known and are described, for example, in U.S. Pat. Nos. 3,241,967, 3,246,988, 3,295,978, 3,462,266, 3,586,506, 3,615,439, 3,650,749, 4,209,580, 4,330,617 and 4,310,612, British Patents 1,023,701, 1,231,830, 1,258,924 and 1,346,920, JP-A-57-40245, JP-A-58-1139, JP-A-58-1140, JP-A-59-182449 and JP-A-59-182450.

The 1-phenyl-3-pyrazolidinone precursors as described in JP-A-59-178458, JP-A-59-182449 and JP-A-59-182450 are particularly preferred.

The electron transfer agent and the precursor thereof can be employed in combination.

According to the present invention, the combination of the electron donor and the electron transfer agent is preferably incorporated into the heat-developable color light-sensitive material.

The electron donor or electron transfer agent or precursor thereof can be used either individually or in combinations of two or more thereof. They may be incorporated into a part of or all emulsion layers (for example, a blue-sensitive layer, a green-sensitive layer, a red-sensitive layer, an infrared-sensitive layer, or an ultraviolet-sensitive layer) or into layers adjacent to the emulsion layers (for example, an antihalation layer, a subbing layer, an interlayer, or a protective layer), or into whole layers.

The electron donor and the electron transfer agent can be added to the same layer or different layers. Further, while these reducing agents can be added to the layer containing the dye providing compound or a different layer therefrom, the non-diffusion electron donor is preferably present together with the dye providing compound in the same layer. The electron transfer agent can be incorporated into an image receiving layer (dye fixing layer), or may be dissolved in water in case of using a slight amount of water at the heat development.

The electron donor and electron transfer agent or precursor thereof can be employed in a combined amount in a range from 0.01 to 50 mol, preferably from 0.1 to 5 mol, per mol of the dye providing compound, and can be employed in a combined amount in a range from 0.001 to 5 mol, preferably from 0.1 to 1.5 mol, per mol of silver halide.

The amount of the electron transfer agent used is at most 60 mol%, preferably at most 40 mol%, of the total amount of the reducing agent. The concentration of the electron transfer agent is preferably in a range from $1\times10^{-4}$ to 1 mol per liter, when the electron transfer agent is supplied by dissolving in water.

In order to incorporate the reducing substance, the dye providing compound, the electron donor, the electron transfer agent or precursor thereof and other hydrophobic additives into a hydrophilic colloid layer, methods described in U.S. Pat. No. 2,322,027, in which these compounds are dissolved in an organic solvent having a high boiling point can be employed. Examples of the organic solvent having a high boiling point include alkyl esters of phthalic acid (e.g., dibutyl phthalate or dioctyl phthalate), phosphoric acid esters (e.g., diphenyl phosphate, triphenyl phosphate, tricyclohexyl phosphate, tricresyl phosphate, or dioctylbutyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate or dioctyl azelate), trimesic acid esters (e.g., tributyl trimesate), carboxylic acids as described in JP-A-63-85633, and compounds as described in JP-A-59-83154, JP-A-59-178451, JP-A-59-178452, JP-A-59-178453, JP-59-178454, JP-A-59-178455 and JP-A-59-178457.

Alternatively, they are dissolved in an organic solvent having a boiling point of from about 30° C. to 160°

C., such as lower alkyl acetates (e.g., ethyl acetate or butyl acetate), ethyl propionate, sec-butyl alcohol, methyl isobutyl ketone, β-ethoxyethyl acetate, methyl cellosolve acetate, or cyclohexanone, and then dispersed in a hydrophilic colloid. The above described organic solvents having a high boiling point and organic solvents having a low boiling point may be used as a mixture thereof. The organic solvent having a low boiling point may be removed by ultrafiltration or other methods from the dispersion, if desired.

The amount of the organic solvent having a high boiling point used in the present invention is at most 10 g, preferably at most 5 g, per g of the dye providing compound used. It is at most 5 g, preferably at most 2 g, per g of the non-diffusion reducing agent. Also, it is at most 1 g, preferably at most 0.5 g, and more preferably 0.3 g, per g of the binder.

Further, it is possible to use a dispersion method using a polymer as described in JP-B-51-39853 (the term "JP-B" as used herein means an "examined Japanese patent publication") and JP-A-51-59943. In addition, the compound may be dispersed directly in an emulsion, or first dissolved in water or an alcohol and then dispersed in gelatin or an emulsion.

In case of using substantially water-insoluble compounds, they can be dispersed as fine particles in a binder, in addition to the above described methods, as described, for example, in JP-A-59-174830, JP-A-53-102733 and JP-A-63-271339.

In order to disperse the hydrophobic substances in a hydrophilic colloid, various surface active agents can be employed. For this purpose, surface active agents as described in JP-A-59-157636, pages 37 to 38 are suitably employed.

The heat-developable light-sensitive material according to the present invention comprises, in substance, a support having thereon a surface latent image type silver halide, a binder, an electron donor, an electron transfer agent and a reducible dye providing compound. Further, it may contain an organic metal salt oxidizing agent, if desired. These compounds are ordinarily added to the same layer in many cases, but may be separately added to different layers as far as they are capable of reacting with each other. For example, decrease in sensitivity can be prevented by incorporating the dye providing compound which is colored into a layer under the silver halide emulsion layer.

The reducing agent is preferably incorporated into the heat-developable light-sensitive material, but may be supplied from outside, by an appropriate method for example, by the diffusion from a dye fixing material as described hereinafter.

In order to obtain a wide range of color in a chromaticity diagram using the three primary colors of yellow, magenta and cyan, at least three silver halide emulsion layers each having sensitivity in a different spectral range are employed in combination. For example, a combination of a blue-sensitive layer, a green-sensitive layer and a red-sensitive layer and a combination of a green-sensitive layer, a red-sensitive layer and an infrared-sensitive layer are illustrated. These light-sensitive layers can be positioned according to various orders known for conventional type color light-sensitive materials. Further, each of these light-sensitive layers may be divided into two or more layers, if desired.

The heat-developable light-sensitive material may have various subsidiary layers, for example, a protective layer, a subbing layer, an interlayer, a yellow filter layer, an antihalation layer, or a back layer.

The silver halide which can be used in the present invention may be any one of silver chloride, silver bromide, silver iodobromide, silver chlorobromide, silver chloroiodide, and silver chloroiodobromide.

The silver halide emulsion to be used in the present invention is a surface latent image type silver halide emulsion. The surface latent image type emulsion is an emulsion in which latent images are formed mainly in the surface portion of grains, and is also called as a negative type emulsion. The definition of the surface latent image type emulslon is described in JP-B-58-9410. The silver halide emulsion to be used in the present invention may be a so-called core/shell emulsion in which the surface thereof differs from the interior thereof in phase.

The silver halide emulsion can be a monodispersed emulsion or a polydispersed emulsion. Also, a mixture of two or more monodispersed emulsions can be employed. The grain size of the silver halide grains is preferably from 0.1 to 2 μm, particularly from 0.2 to 1.5 μm. The crystal habit of the silver halide grains may be any of cubic, octahedral, tetradecahedral or high aspect ratio tabular grains.

Suitable examples of silver halide emulsion which can be used are described, for example, in U.S. Pat. Nos. 4,500,626 (50th column) and 4,628,021, *Research Disclosure,* No. 17029 (1978), and JP-A-62-253159.

The silver halide emulsion may be used unripened. However, it is normally chemically sensitized before use. The silver halide emulsion may be subjected to a sulfur sensitization process, a reduction sensitization process, and a noble metal sensitization process, singly or in combination as known for conventional type light-sensitive materials. These chemical sensitization processes may be effected in the presence of a nitrogen-containing heterocyclic compound as described in JP-A-62-253159.

In the present invention, the amount of light-sensitive silver halide to be coated is in the range from 1 mg/m$^2$ to 10 g/m$^2$ in terms of silver.

In the heat-developable light-sensitive material according to the present invention, an organic metal salt may be employed as an oxidizing agent together with light-sensitive silver halide. Among the organic metal salts, organic silver salts are particularly preferred.

Examples of organic compounds which can be used to form the above-described organic silver salt oxidizing agent include benzotriazoles, fatty acids and other compounds as described, for example, in U.S. Pat. No. 4,500,626 (52nd column to 53rd column). Other useful examples of such organic compounds include silver salts of carboxylic acids containing an alkynyl group such as silver phenylpropiolate as described in JP-A-60-113235 and acetylene silver as described in JP-A-61-249044. Two or more organic silver salts may be used in combination.

These organic silver salts may be used in an amount of from 0.01 to 10 mol, preferably from 0.01 to 1 mol, per mol of surface latent image type silver halide. The total amount of surface latent image type silver halide and organic silver salt to be coated is preferably in the range from 50 mg to 10 g/m$^2$ in terms of silver.

In the present invention, various antifogging agents or photographic stabilizers may be used. Examples of such antifogging agents or photographic stabilizers used include azoles and azaindenes as described in *Research*

*Disclosure,* No. 17643, pages 24 and 25 (1978), carboxylic acids or phosphoric acids containing nitrogen as described in JP-A-59-168442, mercapto compounds and salts thereof as described in JP-A-59-111636, and acetylene compounds as described in JP-A-62-87957.

The silver halide to be used in the present invention may be spectrally sensitized with a methine dye or the like. Examples of such dyes used include cyanine dyes, merocyanine dyes, complex cyanine dyes, complex merocyanine dyes, halopolar cyanine dyes, hemicyanine dyes, styryl dyes and hemioxonol dyes.

Specific examples of such dyes include sensitizing dyes as described in U.S. Pat. No. 4,617,257, JP-A-59-180550, JP-A-60-140335, and *Research Disclosure,* No. 17029, pages 12 and 13 (1978).

These sensitizing dyes may be used singly or in combination. Such a combination of sensitizing dyes is often used particularly for the purpose of supersensitization.

Besides such a sensitizing dye, the present emulsion may contain a dye which has no spectral sensitizing effect itself but exhibits a supersensitizing effect or a substance which does not substantially absorb visible light but exhibits a supersensitizing effect as described in U.S. Pat. No. 3,615,641, and JP-A-63-23145.

The sensitizing dye may be added to the emulsion during, before or after chemical ripening. Alternatively, it may be added before or after the formation of the nucleus of the silver halide grains in accordance with U.S. Pat. Nos. 4,183,756 and 4,225,666.

The amount of the sensitizing dye added is normally in the range from about $10^{-8}$ to $10^{-2}$ mol per mol of silver halide.

As binders of layers for constituting the light-sensitive material or dye fixing material, hydrophilic binders are preferably employed. Examples of such binders are described in JP-A-62-253159, pages 26 to 28. More specifically, transparent or translucent hydrophilic binders are preferred. Suitable examples of such binders include natural substances such as proteins (for example, gelatin and gelatin derivatives), polysaccharides (for example, cellulose derivatives, starch, gum arabic, dextrin and pullulan), and synthetic polymer compounds (for example, polyvinyl alcohol, polyvinyl pyrrolidone and acrylamide polymers).

Further examples of binders include highly water absorptive polymers, that is, homopolymers of vinyl monomer containing -COOM or —$SO_3M$ (M represents a hydrogen atom or an alkali metal) or copolymers composed of two or more of such vinyl monomers or composed of such a vinyl monomer and other vinyl monomer (for example, sodium methacrylate, ammonium methacrylate and Sumikagel® L-5H manufactured by Sumitomo Chemical Co., Ltd.) as described, for example, in JP-A-62-245260.

Two or more of these binders may be employed in combination.

When a system of conducting heat development together with supplying a slight amount of water is adopted, it becomes possible to absorb water rapidly using the above-described highly water absorptive polymer. Further, re-transfer of dyes from a dye fixing material to other materials after dye transfer is prevented by incorporating the highly water absorptive polymer into a dye fixing layer or a protective layer thereof.

In the present invention, the amount of the binder to be coated is preferably 20 g or less, more preferably 10 g or less, particularly preferably 7 g or less, per square meter.

Into layers constituting the light-sensitive material or dye fixing material (including a back layer), various polymer latexes can be incorporated for the purpose of improving physical properties of layers such as increasing dimensional stability and preventing curling, blocking, cracking and pressure sensitization or desensitization. Specifically, any of the polymer latexes as described, for example, in JP-A-62-245258, JP-A-62-136648 and JP-A-62-110066 may be employed. In particular, the cracking of a mordanting layer can be prevented using polymer latex having a low glass transition point (40° C. or less) in the mordanting layer, and the curling is effectively prevented by adding a polymer latex having a high glass transition point to the back layer.

In the present invention, the light-sensitive material may contain a compound which serves to activate development as well as to stabilize images. Specific examples of such compounds which can be preferably used in the present invention are described in U.S. Pat. 4,500,626 (51st column to 52nd column).

In a system which employs diffusion transfer of dyes to form images, a dye fixing material is used together with a light-sensitive material. An embodiment in which a light-sensitive material and a dye fixing material are separately coated on two supports and an embodiment in which a light-sensitive material and a dye fixing material are coated on the same support can be employed.

For the relationship between the light-sensitive material and the dye fixing material, between the light-sensitive material and the support, and between the light sensitive material and a white reflecting layer, those as described in U.S. Pat. No. 4,500,626 (57th column) can be applied to the present invention.

The dye fixing material which can be preferably used in the present invention comprises at least one layer containing a mordant and a binder. Mordants which can be used in the present invention include those known in the field of photography, and specific examples thereof are mordants as described, for example, in U.S. Pat. No. 4,500,626 (58th column to 59th column), JP-A-61-88256 (pages 32 to 41), JP-A-62-244043 and JP-A-62-244036 Further, dye receptive polymer compounds as described in U.S. Pat. No. 4,463,079 may be employed.

The dye fixing material may comprise a subsidiary layer, for example, a protective layer, a stripping layer and an anti-curling layer, if desired. Particularly, it is effective to provide a protective layer.

To the layers constituting the light-sensitive material and dye fixing material, plasticizers, slipping agents, and organic solvents having a high boiling point as improving agents for the stripping property of the light-sensitive material and dye fixing material may be added. Specific examples thereof are those as described, for example, in JP-A-62-253159 (page 25) and JP-A-62-245253.

Moreover, for the purpose described above, various silicone oils (any silicone oils including from dimethyl silicone oil to modified silicone oils obtained by introducing various organic groups to dimethylsiloxane) can be employed. Useful examples of the silicone oils are various modified silicone oils, particularly carboxy-modified silicone (trade name: X-22-3710) as described in *Modified Silicone Oil,* technical data, pages 6 to 18B published by Shin-Etsu Silicone Co. Further, silicone oils as described in JP-A-62-215953 and JP-A-63-46449 are also effective.

In the light-sensitive material and dye fixing material, color fading preventing agents may be employed. Color fading preventing agents which can be used include antioxidants, ultraviolet light absorbing agents and certain kinds of metal complexes.

Suitable examples of antioxidants include chroman series compounds, coumaran series compounds, phenol series compounds (for example, hindered phenols), hydroquinone derivatives, hindered amine derivatives and spiroindane series compounds. Further, compounds as described in JP-A-61-159644 are also effective.

Suitable examples of ultraviolet light absorbing agents include benzotriazole series compounds (those as described in U.S. Pat. No. 3,533,794), 4-thiazolidone series compounds (those as described in U.S. Pat. No. 3,352,681), benzophenone series compounds (those as described in JP-A-46-2784), and compounds as described in JP-A-54-48535, JP-A-62-136641 and JP-A-61-88256. Further, ultraviolet light-absorptive polymers as described in JP-A-62-260152 are effective.

Suitable examples of metal complexes include compounds as described in, for example, U.S. Pat. Nos. 4,241,155, 4,245,018 (3rd column to 36th column), and 4,254,195 (3rd column to 8th column), JP-A-62-174741, JP-A-61-88256 (pages 27 to 29), JP-A-63-199248.

Suitable examples of color fading preventing agents are described in JP-A-62-215272 (pages 125 to 137).

Color fading preventing agents for the purpose of preventing fading of transferred dyes in the dye fixing material can be previously incorporated into the dye fixing material or may be supplied to the dye fixing material from the outside, for example, from the light-sensitive material.

The above-described antioxidants, ultraviolet light absorbing agents and metal complexes may be used in combination.

In the light-sensitive material and dye fixing material, there may be used fluorescent whitening agents. It is particularly preferred to incorporate fluorescent whitening agents into the dye fixing material or to supply them from the outside of the dye fixing material, for example, from the light-sensitive layer. Suitable examples of fluorescent whitening agents are described, for example, in K. Veenkataraman, *The Chemistry of Synthetic Dyes,* Vol. V, Chapter 8 and JP-A-61-143752. More specifically, preferred fluorescent whitening agents include stilbene series compounds, coumarin series compounds, biphenyl series compounds, benzoxazole series compounds, phthalimide series compounds, pyrazoline series compounds and carbostyryl series compounds.

The fluorescent whitening agents may be employed in combination with the color fading preventing agents.

Suitable examples of hardeners which can be used in the layers constituting the light-sensitive material or dye fixing material include those as described, for example, in U.S. Pat. No. 4,678,739 (41st column), JP-A-59-116655, JP-A-62-245261 and JP-A-61-18942. More specifically, aldehyde series hardeners (for example, formaldehyde), aziridine series hardeners, epoxy series hardeners (for example,

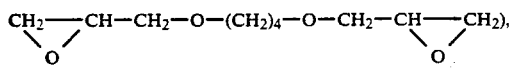

vinylsulfone series hardeners (for example, N,N'-ethylenebis(vinylsulfonylacetamido)ethane), N-methylol series hardeners (for example, dimethylolurea), and polymer hardeners (for example, compounds as described in JP-A-62-234157).

In the layers constituting the light-sensitive material and dye fixing material, various surface active agents are employed as coating aids or for other purposes, for example, improvement in stripping property, improvement in sliding property, antistatic property, and development acceleration. Specific examples of useful surface active agents are described, for example, in JP-A-62-173463 and JP-A-62-183457.

Into the layers constituting the light-sensitive material or and dye fixing material, organic fluoro compounds may be incorporated for the purpose of improvement in sliding property, antistatic property, and improvement in stripping property. Typical examples of the organic fluoro compounds include fluorine series surface active agents as described, for example, in JP-B-57-9053 (8th column to 17th column), JP-A-61-20944 and JP-A-62-135826, oily fluorine series compounds such as fluoro oil, and hydrophobic fluorine compounds such as solid fluoro resin compounds, for example, tetrafluoroethylene resin.

In the light-sensitive material and dye fixing material, matting agents can be used. Suitable examples of matting agents include silicon dioxide, compounds such as polyolefins and polymethacrylates as described in JP-A-61-88256 (page 29), as well as compounds such as benzoguanamine resin beads, polycarbonate resin beads and AS resin beads as described in JP-A-279944 and JP-A-63-274952.

Furthermore, into the layers constituting the light-sensitive material and dye fixing material, other additives, for example, heat solvents, defoaming agents, sterilizers, antimolds, and colloidal silica may be incorporated. Specific examples of these additives are described in JP-A-61-88256 (pages 26 to 32).

In the light-sensitive material and/or dye fixing material according to the present invention, image formation accelerating agents can be employed. Such image formation accelerating agents serve to accelerate, for example, an oxidation reduction reaction of a silver salt oxidizing agent with a reducing agent, a reaction such as formation or decomposition of a dye or release of a diffusible dye from a dye providing compound, and migration of a dye from a light-sensitive material layer to a dye fixing layer. In the light of physicochemical function, image formation accelerating agents can be classified into bases or base precursors, nucleophilic compounds, organic solvents having a high boiling point (oils), heat solvents, surface active agents, and compounds capable of interacting with silver or silver ion. However, these substance groups generally have a composite function and thus a combination of the above-described accelerating effects. The details thereof are described in U.S. Pat. No. 4,678,739 (38th column to 40th column).

Examples of useful base precursors include salts of organic acids and bases which decompose by heating with decarboxylation, and compounds which release an amine upon decomposition with an intramolecular nucleophilic displacement reaction, a Lossen rearrangement reaction or a Beckmann rearrangement reaction. Specific examples thereof are described, for example, in U.S. Pat. No. 4,511,493 and JP-A-62-65038.

In a system wherein heat development and transfer of dye are simultaneously conducted in the presence of a small amount of water, it is preferred to incorporate a base and/or a base precursor into the dye fixing material from the standpoint of increasing preservability of the light-sensitive material.

In addition, combinations of sparingly soluble metal compounds and compounds (referred to as complex forming compounds) capable of forming a complex with a metal ion constituting the sparingly soluble metal compound as described in European Pat. No. 210,660A, and compounds which generate a base upon electrolysis as described in JP-A-61-232451 can be employed as base precursors. Particularly, the former method is effective. It is advantageous that the sparingly soluble metal compound and the complex forming compound are added separately to the light-sensitive material and the dye fixing material.

In the light-sensitive material and/or dye fixing material, various development stopping agents can be used for the purpose of ensuring constant image quality regardless of any fluctuation in processing temperature and time during development.

The term "development stopping agent" as used herein means a compound which rapidly neutralizes or reacts with a base to decrease the base concentration in the layer so that development is stopped after proper development, or a compound which interacts with silver or silver salt to inhibit development after proper development. Specific examples of such development stopping agents include acid precursors which release an acid upon heating, electrophilic compounds which undergo a displacement reaction with a base present therewith upon heating, and nitrogen-containing heterocyclic compounds, mercapto compounds and precursors thereof. More specifically, those described in JP-A-62-253159 (pages 31 and 32) are employed.

Supports used in the light-sensitive material and dye fixing material according to the present invention are those which can endure the processing temperature. In general, paper and synthetic polymer films are employed. More specifically, films of polyethylene terephthalate, polycarbonates, polyvinyl chloride, polystyrene, polypropylene, polyimides and celluloses (for example, triacetyl cellulose) or those films containing pigments such as titanium oxide, synthetic paper produced from polypropylene, paper manufactured from a mixture of synthetic pulp such as polyethylene and natural pulp, Yankee paper, baryta paper, coated paper (particularly cast coated paper), metals, cloths, and glass are employed. These may be employed individually or as supports one or both surfaces of which .are laminated with synthetic polymers such as polyethylene. Further, supports as described in JP-A-62-253159 (pages 29 to 31) are usable.

On the surface of the support, a mixture of a hydrophilic binder and a semiconductive metal oxide such as alumina sol and tin oxide, an antistatic agent such as carbon black may be coated.

In order to imagewise expose the light-sensitive material for recording, various methods can be utilized, for example, a method of direct photographing a landscape or portrait using a camera, a method of exposure through a reversal film or a negative film by means of a printer or an enlarger, a method of scanning exposure of an original through a slit using an exposure device of a copying machine, a method wherein image information is exposed upon light emission from a light emitting diode or various lasers via electric signals, and a method wherein image information on an image display device, for example, CRT, liquid crystal display, electroluminescence display, or plasma display is exposed directly or through an optical system.

Light sources for recording images on the light-sensitive material which can be used include those as described in U.S. Pat. No. 4,500,626 (56th column) such as natural light, tungsten lamps, light emitting diodes, laser light sources, and CRT light sources, as described above.

Furthermore, image exposure may be conducted using a wavelength conversion element composed of a combination of a nonlinear optical material and a coherent light source such as laser light. The nonlinear optical material is a material capable of generating nonlinearity between polarization and an electric field which occurs when a strong photoelectric field such as laser light is provided. Specific examples of the nonlinear optical materials which can be preferably used include inorganic compounds represented by, for example, lithium niobate, potassium dihydrogenphosphate (KDP), lithium iodate, or $BaB_2O_4$, urea derivatives, nitroaniline derivatives, nitropyridine-N-oxide derivatives such as 3-methyl-4-nitropyridine-N-oxide (POM), or compounds as described in JP-A-61-53462 and JP-A-62-210432. As the form of the wavelength conversion element, a single crystal light conducting wave guide type and a fiber type are known, and they may be effectively employed.

Moreover, the above-described image information sources which may be used include image signals obtained by a video camera or an electro still camera, television signals represented by Japan Television Signal Standard (NTSC), image signals obtained by dividing an original into many dots by means of a scanner, and image signals prepared by means of a computer represented by CG and CAD.

The light-sensitive material and/or dye fixing material may have an electroconductive heat-generating layer (heating element) as a heating means for heat development or diffusion transfer of dyes as the heating element, transparent or opaque in this case, those as described in JP-A-61-145544 are utilizable. The electroconductive layer acts also as an antistatic layer.

The heating temperature required for the heat development step is ordinarily in the range from about 50° C. to about 250° C., preferably from about 80° C. to about 180° C. The diffusion transfer step of dyes can be performed simultaneously with or after the heat development step. In the latter case, the transfer can be conducted at a temperature ranging from the temperature for the heat development to room temperature, particularly preferably at a temperature ranging from 50° C. to about 10° C. lower than the temperature at the heat development step.

The migration of dyes may occur only by heating, but an appropriate solvent may be employed in order to accelerate the transfer of dyes. Further, as described in detail in JP-A-59-218443 and JP-A-61-238056, a process in which a light-sensitive material is heated in the presence of a small amount of a solvent, particularly water so that development and transfer are simultaneously or sequentially effected is useful. In such a process, the heating temperature is preferably in the range from 50° C. to not higher than the boiling point of the solvent used. For example, if the solvent is water, a suitable heating temperature is in the range from 50° C. to 100° C.

Examples of such a solvent which can be used to accelerate development and/or migration of diffusible dyes to the dye fixing layer include water, and particularly a basic aqueous solution containing an inorganic alkali metal salt or an organic base as described with reference to the image formation accelerator. There can also be used a solvent having a low boiling point, or a mixture of a solvent having a low boiling point and water or a basic aqueous solution. Additionally, a surface active agent, an antifogging agent, a sparingly soluble metal salt, or a complex forming compound may be contained in the solvent. Particularly preferred among these solvents is water.

These solvents may be imparted to either or both of the dye fixing material and the light-sensitive material. The amount of the solvent to be used may be as small as less than the weight of the solvent of a volume equivalent to the maximum wet volume of the entire coated film (particularly, not more than the value obtained by subtracting the weight of the entire coated film from the weight of the solvent of a volume equivalent to the maximum wet volume of the entire coated film).

Methods for providing such a solvent to the light-sensitive layer or the dye fixing layer which can be used include those described in JP-A-61-147244 (page 26). Alternatively, the solvent may be previously incorporated into either the light-sensitive material or the dye fixing material or both of them in the form of microcapsule.

Furthermore, a system may be used in which a hydrophilic heat solvent which stays solid at normal temperature but melts at an elevated temperature is incorporated in the light-sensitive material or the dye fixing material in order to accelerate the migration of dyes. Such a hydrophilic heat solvent may be incorporated in either or both of the light-sensitive material and the dye fixing material. The layer in which the hydrophilic heat solvent is to be incorporated is any of the emulsion layer, interlayer, protective layer, and dye fixing layer, particularly the dye fixing layer and/or an adjacent layer thereto.

Examples of the hydrophilic heat solvent include ureas, pyridines, amides, sulfonamides, imides, alcohols, oximes, and other heterocyclic compounds.

Moreover, in order to accelerate the migration of dyes, an organic solvent having a high boiling point may be incorporated into the light-sensitive material and/or the dye fixing material.

Suitable heating methods for the development step and/or transfer step include contact with a heated block or plate, a hot plate, a hot presser, a hot roller, a halogen lamp heater, or an infrared or far infrared lamp heater, or passing through a high temperature atmosphere.

The pressure condition and pressure application process to be used when the light-sensitive material and the dye fixing material are brought into close contact with each other are described in JP-A-61-147244 (page 27).

Processing of the heat-developable light-sensitive materials according to the present invention can be carried out by means of any of various heat development machines. Preferably used heat development machines include those described, for example, in JP-A-9-75247, JP-A-59-177547, JP-A-59-181353, JP-A-60-18951 and JP-A-U-62 25944 (the term "JP-A-U" as used herein means an "unexamined published Japanese utility model application").

The present invention will be explained in greater detail with reference to the following examples, but the present invention should not be construed as being limited thereto.

EXAMPLE 1

(1) Preparation of Silver Halide Emulsion

Emulsion (I)

600 ml of an aqueous solution containing sodium chloride and potassium bromide and an aqueous solution of silver nitrate which had been prepared by dissolving 0.59 mol of silver nitrate in 600 ml of water were simultaneously added to an aqueous solution of gelatin which had been prepared by dissolving 20 g of gelatin and 3 g of sodium chloride in 1,000 ml of water and kept at a temperature of 75° C. at the same flow rate over a period of 40 minutes while the latter was being vigorously stirred. Thus, a monodispersed cubic silver chlorobromide emulsion (bromide content: 80 mol%) having an average grain size of 0.35 μm was prepared.

After being washed with water and desalted, the emulsion was chemically sensitized with 5 mg of sodium thiosulfate and 20 mg of 4-hydroxy-6-methyl-1,3,3a,7-tetraazaindene at a temperature of 60° C. The yield of the emulsion was 600 g.

Emulsion (II)

600 ml of an aqueous solution containing sodium chloride and potassium bromide, an aqueous solution of silver nitrate which had been prepared by dissolving 0.59 mol of silver nitrate in 600 ml of water and Dye Solution (I) described below were simultaneously added to an aqueous solution of gelatin which had been prepared by dissolving 20 g of gelatin and 3g of sodium chloride in 1,000 ml of water and kept at a temperature of 75° C. at the same flow rate over a period of 40 minutes while the latter was being stirred vigorously. Thus, a monodispersed cubic silver chlorobromide emulsion adsorbed with dye (bromide content: 80 mol%) having an average grain size of 0.35 μm was prepared.

After being washed with water and desalted, the emulsion was chemically sensitized with 5 mg of sodium thiosulfate and 20 mg of 4-hydroxy-6-methyl-1,3,3*a*,7-tetraazaindene at a temperature of 60° C. The yield of the emulsion was 600 g.

Dye Solution (I)

160 mg of Sensitizing Dye (I) shown below was dissolved in 400 ml of methanol.

Sensitizing Dye (I)

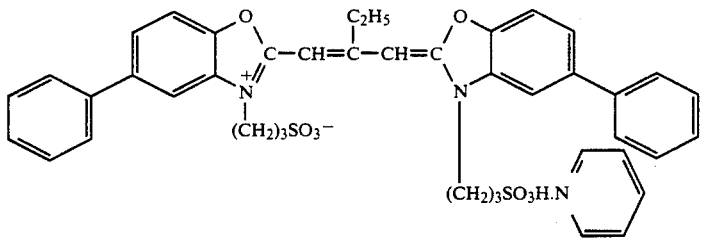

Emulsion (III)

1,000 ml of an aqueous solution containing potassium iodide and potassium bromide and an aqueous solution of silver nitrate which had been prepared by dissolving 1 mol of silver nitrate in 1,000 ml of water were simultaneously added to an aqueous solution of gelatin which had been prepared by dissolving 20 g of gelatin and ammonia in 1,000 ml of water and kept at a temperature of 50° C. with maintaining a pAg at the constant value while the latter was being stirred vigorously. Thus, a monodispersed octahedral silver iodobromide emulsion (iodide content: 1.6 mol%) having an average grain size of 0.5 μm was prepared.

After being washed with water and desalted, the emulsion was gold and sulfur sensitized with 5 mg of chloroauric acid (tetrahydrate) and 2 mg of sodium thiosulfate at a temperature of 60° C. The yield of the emulsion was 1 kg.

(2) Preparation of Gelatin Dispersion of Dye Providing Compound (I) Gelatin Dispersion of Yellow Dye Providing Compound 13 g of a yellow dye providing compound (Compound (D-1)), 6.5 g of an organic solvent having a high boiling point (1) and 6.5 g of electron donor (Compound (ED-1)) were dissolved in 37 ml of cyclohexanone, the resulting solution was mixed with stirring with 100 g of a 10% aqueous solution of gelatin and 60 ml of a 2.5% aqueous solution of sodium dodecylbenzenesulfonate, and the mixture was then dispersed by means of a homogenizer at 10,000 rpm for 10 minutes. The dispersion thus obtained was designated a dispersion of yellow dye providing compound.

(II) Gelatin Dispersion of Magenta Dye Providing Compound 16.8 g of a magenta dye providing compound (Compound (D-2)), 8.4 g of an organic solvent having a high boiling point (1) and 6.3 g of an electron donor (Compound (ED-1)) were dissolved in 37 ml of cyclohexanone, the resulting solution was mixed with stirring with 100 g of a 10% aqueous solution of gelatin and 60 ml of a 2.5% aqueous solution of sodium dodecylbenzenesulfonate, and the mixture was then dispersed by means of a homogenizer at 10,000 rpm for 10 minutes. The dispersion thus obtained was designated a dispersion of magenta dye providing compound.

(III) Gelatin Dispersion of Cyan Dye Providing Compound 15.4 g of a cyan dye providing compound (Compound (D-3)), 7.7 g of an organic solvent having a high boiling point (1) and 6.0 g of electron donor (Compound (ED-1)) were dissolved in 37 ml of cyclohexanone, the resulting solution was mixed with stirring with 100 g of a 10% aqueous solution of gelatin and 60 ml of a 2.5% aqueous solution of sodium dodecylbenzenesulfonate, and the mixture was then dispersed by means of a homogenizer at 10,000 rpm for 10 minutes. The dispersion thus obtained was designated a dispersion of cyan dye providing compound.

Heat-Developable Light Sensitive Material 1

Heat-developable Light-sensitive Material 1 having the multilayer structure described in Table 1 below was prepared using the components thus-prepared.

TABLE 1

| |
|---|
| Sixth Layer: Protective Layer |
| Gelatin (0.91 g/m$^2$), Matting agent (silica) (0.03 g/m$^2$), Water-soluble polymer (1) (0.23 g/m$^2$), Surface active agent (1) (0.06 g/m$^2$), Surface active agent (2) (0.13 g/m$^2$), Hardening agent (1) (0.01 g/m$^2$), $ZnSO_4.7H_2O$ (0.06 g/m$^2$) |
| Fifth Layer: Blue-Sensitive Layer |
| Emulsion (III) (0.58 g/m$^2$ as silver), Gelatin (0.68 g/m$^2$), Precursor of electron transfer agent (1) (0.05 g/m$^2$), Yellow dye providing compound (D-1) (0.5 g/m$^2$), Organic solvent having a high boiling point (1) (0.25 g/m$^2$), Electron donor (ED-1) (0.25 g/m$^2$), Surface active agent (3) (0.05 g/m$^2$), Electron transfer agent (1) (0.03 g/m$^2$), Hardening agent (1) (0.01 g/m$^2$), Water-soluble polymer (2) (0.02 g/m$^2$), Antifogging agent (1) (0.8 mg/m$^2$) |
| Fourth Layer: Interlayer |
| Gelatin (0.75 g/m$^2$), $Zn(OH)_2$ (0.32 g/m$^2$), Reducing agent (1) (0.11 g/m$^2$), Surface active agent (1) (0.02 g/m$^2$), Surface active agent (4) (0.07 g/m$^2$), Water-soluble polymer (2) (0.02 g/m$^2$), Hardening agent (1) (0.01 g/m$^2$) |
| Third Layer: Green-Sensitive Layer |
| Emulsion (II) (0.41 g/m$^2$ as silver), Gelatin (0.47 g/m$^2$), Precursor of electron transfer agent (1) (0.05 g/m$^2$), Magenta dye providing compound (D-2) (0.37 g/m$^2$), Organic solvent having a high boiling point (1) (0.19 g/m$^2$), Electron donor (ED-1) (0.14 g/m$^2$), Surface active agent (3) (0.04 g/m$^2$), Electron transfer agent (1) (0.03 g/m$^2$), Hardening agent (1) (0.01 g/m$^2$), Water-soluble polymer (2) (0.02 g/m$^2$), Antifogging agent (2) (1.1 mg/m$^2$) |
| Second Layer: Interlayer |
| Gelatin (0.80 g/m$^2$), $Zn(OH)_2$ (0.31 g/m$^2$), Reducing agent (1) (0.11 g/m$^2$), Surface active agent (1) (0.06 g/m$^2$), Surface active agent (4) (0.10 g/m$^2$), Water-soluble polymer (2) (0.03 g/m$^2$), Hardening agent (1) (0.01 g/m$^2$) |
| First Layer: Red-Sensitive Layer |
| Emulsion (I) (0.36 g/m$^2$ as silver), Sensitizing Dye (II) ($1.07 \times 10^{-3}$ g/m$^2$), Gelatin (0.49 g/m$^2$), Precursor of electron transfer agent (1) (0.05 g/m$^2$), Cyan dye providing compound (D-3) (0.37 g/m$^2$), Organic solvent having a high boiling point (1) (0.18 g/m$^2$), Electron donor (ED-1) (0.14 g/m$^2$), surface active agent (3) (0.04 g/m$^2$), Electron transfer agent (1) (0.03 g/m$^2$), Hardening agent (1) (0.01 g/m$^2$), Water-soluble polymer (2) (0.02 g/m$^2$), Antifogging agent (3) (1.5 mg/m$^2$) |
| Support: |
| Polyethylene terephthalate (thickness: 100 μm) |
| Back Layer: |
| Carbon black (0.44 g/m$^2$), Polyester (0.30 g/m$^2$), Polyvinyl chloride (0.30 g/m$^2$) |

The additives shown in Table 1 above other than those described hereinbefore are illustrated below.

Water-soluble polymer (1)

Sumikagel® L-5H manufactured by sumitomo Chemical Co. Ltd.

Water-soluble polymer (2)

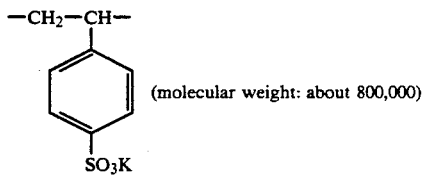

Surface active agent (1)

Aerosol® TO

Surface active agent (2)

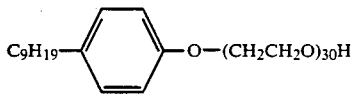

Surface active agent (3)

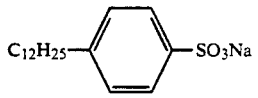

Surface active agent (4)

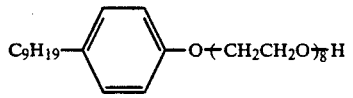

Hardening agent (1)

1,2-Bis(vinylsulfonylacetamido)ethane

Organic solvent having a high boiling point (1)

Tricyclohexyl phosphate

Electron transfer agent (1)

Compound (X-2)

Precursor of electron transfer agent (1)

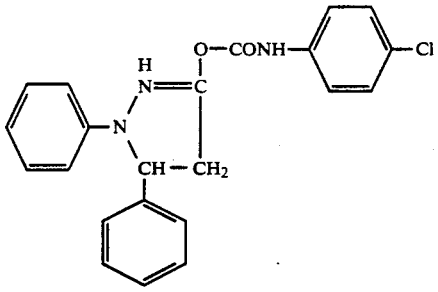

Sensitizing Dye (II)

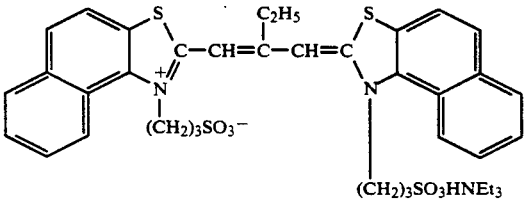

Reducing agent (1)

Compound (ED-7)

Antifogging agent (1)

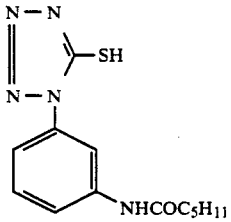

Antifogging agent (2)

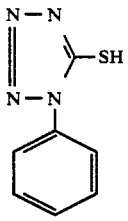

Antifogging agent (3)

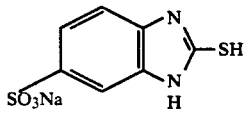

Heat-Developable Light-Sensitive Materials 2 to 6

Light-sensitive materials 2 to 6 were prepared in the same manner as described for Light-sensitive Material 1, except adding the compounds according to the present invention as shown in Table 3 below in an amount of $5.0\times10^{-7}$ mol per mol of silver halide to each of the first layer, third layer and fifth layer of Light-sensitive material 1, respectively.

(3) Preparation of Dye Fixing Material

A dye fixing material was prepared by coating each layer having the composition shown in Table 2 below on a polyethylene laminated paper support.

TABLE 2

| |
|---|
| Third Layer: |
| Gelatin (0.05 g/m$^2$), Silicone oil (0.04 g/m$^2$), Surface active agent (1) (0.001 g/m$^2$), Surface active agent (2) (0.02 g/m$^2$), Surface active agent (3) (0.10 g/m$^2$), Guanidium picolinate (0.45 g/m$^2$), Polymer (0.24 g/m$^2$) |
| Second Layer: |
| Mordant (2.35 g/m$^2$), Polymer (0.60 g/m$^2$), Gelatin (1.40 g/m$^2$), Organic solvent having a high boiling point (1.40 g/m$^2$), Guanidium picolinate (1.80 g/m$^2$), Surface active agent (1) (0.02 g/m$^2$) |
| First Layer: |
| Gelatin (0.45 g/m$^2$), Surface active agent (3) (0.01 g/m$^2$), Polymer (0.04 g/m$^2$), Hardening agent (0.30 g/m$^2$) |
| Support: |
| Polyethylene laminated paper (thickness: 170 μm) |
| First Back Layer: |
| Gelatin (3.25 g/m$^2$), Hardening agent (0.25 g/m$^2$) |
| Second Back Layer: |
| Gelatin (0.44 g/m$^2$), Silicone oil (0.08 g/m$^2$), Surface active agent (1) (0.002 g/m$^2$), Matting agent (0.09 g/m$^2$) |

The additives shown in Table 2 above are illustrated below.

Silicone oil

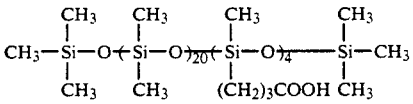

Surface active agent (1)

Aerosol ® TO

Surface active agent (2)

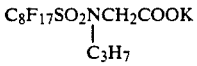

Surface active agent (3)

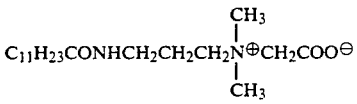

Polymer

Copolymer of vinyl alcohol and sodium acrylate (75:25 in molar ratio)

Dextran (molecular weight: 70,000)

Mordant

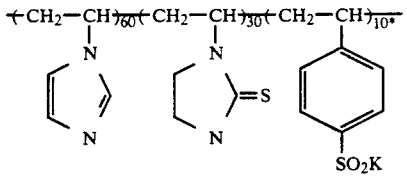

*molar ratio

Organic solvent having a high boiling point

Rheophos ® 95 manufactured by Ajinomoto Co., Inc.

Hardening agent

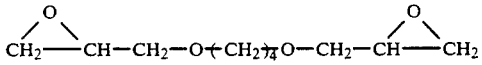

Matting agent

Benzoguanamine resin (average particle size: 10 μm)

The multilayer color light-sensitive material as described above was exposed to light through a color separation filter of B, G and R and a grey filter, the density of each of which continuously changes, for 1/10 second using a 4,000 lux tungsten lamp. On the emulsion side surface of the exposed light-sensitive material transformed at a line speed of 20 mm/sec. was supplied water at a rate of 15 ml/m$^2$ by a wire bar and then immediately it was superimposed on the dye fixing material in such a manner that their coated layers were in contact with each other. These materials were heated for 15 seconds using a heat roller which had been so adjusted that the temperature of the layers containing absorbed water became 85° C.

Then, the dye fixing material was peeled apart from the light-sensitive material, whereupon blue, green, red and grey images were obtained in the dye fixing material corresponding to the color separation filter of B, G and R and the grey filter, respectively.

The maximum density ($D_{max}$) and the minimum density ($D_{min}$) of each of cyan, magenta and yellow colors at the grey area were measured.

The results thus-obtained are shown in Table 3.

TABLE 3

| Light-Sensitive Material | Compound | Minimum Density | | | Maximum Density | | |
|---|---|---|---|---|---|---|---|
| | | Cyan | Magenta | Yellow | Cyan | Magenta | Yellow |
| 1 (Comparison) | — | 0.27 | 0.32 | 0.29 | 1.93 | 2.20 | 1.82 |
| 2 (Present Invention) | (2) | 0.16 | 0.20 | 0.17 | 1.91 | 2.20 | 1.80 |
| 3 (Present Invention) | (3) | 0.14 | 0.17 | 0.15 | 2.00 | 2.23 | 1.94 |
| 4 (Present Invention) | (8) | 0.14 | 0.18 | 0.15 | 1.97 | 2.22 | 1.90 |
| 5 (Present Invention) | (12) | 0.18 | 0.21 | 0.19 | 1.92 | 2.19 | 1.83 |
| 6 (Present Invention) | (14) | 0.14 | 0.16 | 0.14 | 1.93 | 2.21 | 1.84 |

From the results shown in Table 3, it is apparent that the light-sensitive material using the compound according to the present invention exhibit a low minimum density without causing decrease in the maximum density.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having thereon at least a surface latent image type silver halide, a binder, an electron transfer agent or a precursor thereof, an electron donor, a reducible dye providing compound capable of releasing a diffusible dye upon being reduced with the electron donor and a hydrazine derivative in a sufficient amount to control the Dmin to a low level without decreasing the Dmax, wherein the hydrazine derivative is a compound represented by the following general formula (I):

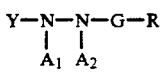

(I)

wherein Y represents an aliphatic group, an aromatic group or a heterocyclic group; $A_1$ and $A_2$ each represents a hydrogen atom or one of them represents a hydrogen atom and the other represents an alkylsulfonyl group, an arylsulfonyl group or

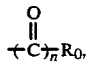

wherein $R_0$, represents an alkyl group an alkenyl group, an aryl group, an alkoxy group or an aryloxy group; and n represents an integer from 1 to 2; R represents a hydrogen atom, an alkyl group, an aralkyl group, an aryl group, an alkoxy group, an aryloxy group, an amino group, an alkoxycarbonyl group, an aryloxycarbonyl group, a carbamoyl group, an azo group or a heterocyclic group; G represents a carbonyl group, a sulfonyl group, a sulfoxy group,

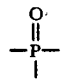

or an iminomethylene group; provided that G, $A_1$, $A_2$ and the hydrazine nitrogen atoms may form a hydrazone structure, >N—N=C<, and wherein (a) the molar amount of the hydrazine derivative is in the range of from $1\times10^{-9}$ to $1\times10^{-3}$ mol per mol of surface latent image type silver halide;

(b) the amount of the dye releasing compound is in the range of from 0.05 to 5 mmol/$m^2$;

(c) the amount of electron donor is in the range of from 0.01 to 50 mol per mol of the positive dye providing compound and from 0.001 to 5 mol per mol of silver halide;

(d) the electron donor and electron transfer agent or precursor thereof are employed in a combined amount in the range of from 0.01 to 50 mol per mol of dye providing compound and in a combined amount in a range of from 0.001 to 5 mol per mol of silver halide; and (e) the amount of the electron transfer agent is at most 60 mol% of the total amount of the reducing agent.

2. A heat-developable light-sensitive material as claimed in claim 1, wherein the aliphatic group represented by Y is a straight chain, branched chain or cyclic alkyl group, alkenyl group or alkynyl group.

3. A heat-developable light-sensitive material as claimed in claim 1, wherein the aromatic group represented by Y is a monocyclic or dicyclic aryl group.

4. A heat-developable light-sensitive material as claimed in claim 1, wherein the heterocyclic group represented by Y is a 3-membered to 10-membered, saturated or unsaturated heterocyclic group having at least one of N, O, and S.

5. A heat-developable light-sensitive material as claimed in claim 1, wherein the group represented by Y is substituted with one or more substituents selected from an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an aryloxycarbonyl group, an acyl group, an alkoxycarbonyl group, an acyloxy group, a carbonamido group, a sulfonamido group, and a nitro group.

6. A heat-developable light-sensitive material. as claimed in claim 1, wherein Y is an aryl group.

7. A heat-developable light-sensitive material as claimed in claim 1, wherein, when G is a carbonyl group, R is a hydrogen atom, an alkyl group, an aralkyl group, an aryl group, an alkoxy group, an aryloxy group, an amino group, an alkoxycarbonyl group, an aryloxycarbonyl group, a carbamoyl group, an azo group or a heterocyclic group.

8. A heat-developable light-sensitive material as claimed in claim 7, wherein R is a hydrogen atom.

9. A heat-developable light-sensitive material as claimed in claim 1, wherein, when G is a sulfonyl group, R is an alkyl group, an aralkyl group, an aryl group or a substituted amino group.

10. A heat-developable light-sensitive material as claimed in claim 1, wherein, when G is a sulfoxy group, R is a cyanobenzyl group or a methylthiobenzyl group.

11. A heat-developable light-sensitive material as claimed in claim 1, wherein, when G is

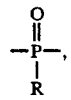

R is a methoxy group, an ethoxy group, a butoxy group, a phenoxy group or a phenyl group.

12. A heat-developable light-sensitive material as claimed in claim 11, wherein R is a phenoxy group.

13. A heat-developable light-sensitive material as claimed in claim 1, wherein, when G is an N-substituted or unsubstituted iminomethylene group, R is a methyl group, an ethyl group or a substituted or unsubstituted phenyl group.

14. A heat-developable light-sensitive material as claimed in claim 1, wherein G is a carbonyl group.

15. A heat-developable light-sensitive material as claimed in claim 1, wherein the group represented by R is substituted with one or more substituents selected from an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an aryloxycarbonyl group, an acyl group, an alkoxycarbonyl group, an acyloxy group, a carbonamido group, a sulfonamido group, and a nitro group.

16. A heat-developable light-sensitive material as claimed in claim 1, wherein the group represented by Y or R contains a ballast group.

17. A heat-developable light-sensitive material as claimed in claim 16, wherein the total number of carbon atoms included in Y and R is at least 12.

18. A heat-developable light-sensitive material as claimed in claim 1, wherein the group represented by Y or R contains a group which accelerates the adsorption of the compound represented by the general formula (I) on the surface of silver halide grain and represented by the following formula:

$$X_0-L_0)_{m0}$$

wherein $X_0$ represents an adsorption accelerating group for silver halide; $L_0$ represents a divalent linkage group; and $m_0$ represents 0 or 1.

19. A heat-developable light-sensitive material as claimed in claim 18, wherein the adsorption accelerating group for silver halide represented by $X_0$ is a thioamido group, a mercapto group, a group having a disulfide bond or a 5-membered or 6-membered nitrogen-containing heterocyclic group.

20. A heat-developable light-sensitive material as claimed in claim 18, wherein the divalent linkage group represented by $L_o$ is an atom selected from C, N, S, and O or an atomic group having at least one of C, N, S, and O.

21. A heat-developable light-sensitive material as claimed in claim 1, wherein $A_1$ and $A_2$ each represents a hydrogen atom.

22. A heat-developable light-sensitive material as claimed in claim 1, wherein the compound represented by the general formula (I) is a compound represented by the following general formula (II):

$$(Y_1-L_2)_l L_1-\overset{A_1}{\overset{|}{N}}-\overset{A_2}{\overset{|}{N}}-G-R \qquad \text{(II)}$$

wherein $A_1$, $A_2$, G and R each has the same meaning as defined in the general formula (I); $L_1$ represents an arylene group; $L_2$ represents a divalent linkage group; $Y_1$ represents an aliphatic group or an aromatic group; l represents an integer from 0 to 3; and the total number of carbon atoms included in R, $L_1$, $L_2$ and $Y_1$ is at least 12.

23. A heat-developable light-sensitive material as claimed in claim 22, wherein $L_1$ is a phenylene group.

24. A heat-developable light-sensitive material as claimed in claim 22, wherein $L_2$ is an alkylene group, an alkenylene group; an alkynylene group; an arylene group; —O—; —S—;

$$-\underset{\underset{R_{00}}{|}}{N}-,$$

wherein $R_{00}$ represents a hydrogen atom, a straight chain, branched chain or cyclic, substituted or unsubstituted alkyl group having at most 30 carbon atoms or a substituted or unsubstituted phenyl or naphthyl group having at most 30 carbon atoms; —N=; —CO—; —$SO_2$—; or a combination thereof.

25. A heat-developable light-sensitive material as claimed in claim 22, wherein $Y_1$ is a substituted or unsubstituted branched chain or cyclic alkyl group having at most 70 carbon atoms or a substituted or unsubstituted aryl group having from 6 to 70 carbon atoms.

26. A heat-developable light-sensitive material as claimed in claim 22, wherein l is 1 or 2.

27. A heat-developable light-sensitive material as claimed in claim 22, wherein the total number of carbon atoms included in $L_1$, $L_2$ and $Y_1$ is from 12 to 70.

28. A heat-developable light-sensitive material as claimed in claim 1, wherein the hydrazine derivative is present in a light-sensitive layer.

29. A heat-developable light-sensitive material as claimed in claim 1, wherein the reducible dye providing compound is a compound represented by the following general formula (C-I):

$$PWR-Time_tDye \qquad \text{(C-I)}$$

wherein PWR represents a group capable of releasing —Time)$_t$ Dye upon being reduced; Time represents a group capable of releasing Dye via a subsequent reaction after —Time)$_t$ Dye being released from PWR; t represents 0 or 1; and Dye represents a dye or a precursor thereof.

30. A heat-developable light-sensitive material as claimed in claim 29, wherein the compound represented by the general formula (C-I) is a compound represented by the following general formula (C-II):

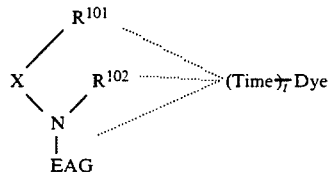

(C-II)

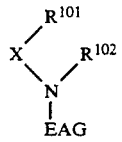

corresponds to PWR in the general formula (C-I); X represents an oxygen atom, a sulfur atom or a nitrogen-containing group, —$NR^{103}$—; EAG represents a group capable of receiving an electron from a reducing substance; $R^{101}$, $R^{102}$ and $R^{103}$ each represents a simple bond or a group other than a hydrogen atom, or $R^{101}$, $R^{102}$ and $R^{103}$ combine with each other to form a 5-membered to 8-membered ring; (Time)$_t$ Dye is bonded to at least one of $R^{101}$, $R^{102}$ or EAG; and Time, t and Dye each has the same meaning as defined in the general formula (C-I).

31. A heat-developable light-sensitive material as claimed in claim 30, wherein the compound represented by the general formula (C-II) is a compound represented by the following general formula (C-III):

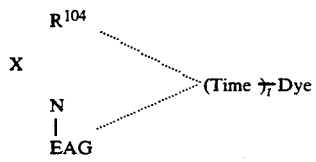

(C-III)

wherein $(Time)_t$ Dye is bonded to at least one of $R^{104}$ and EAG; X, EAG, Time, t and Dye each has the same meaning as defined in the general formula (C-II); and $R^{104}$ represents an atomic group bonded to X and the nitrogen atom necessary to form a 5-membered to 8-membered monocyclic or condensed heterocyclic ring together with X and the nitrogen atom.

32. A heat-developable light-sensitive material as claimed in claim 31, wherein the group represented by EAG is a group represented by the following general formula (A):

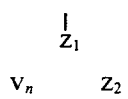

(A)

wherein $Z_1$ represents

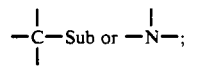

Vn represents an atomic group necessary to form a 3-membered to 8-membered aromatic ring together with $Z_1$ and $Z_2$; n represents an integer from 3 to 8; $V_n$ means the following:

$V_3$: $-Z_3-$, $V_4$: $-Z_3-Z_4-$, $V_5$: $-Z_3-Z_4-Z_5-$, $V_6$: $-Z_3-Z_4-Z_5-Z_6-$, $V_7$: $-Z_3-Z_4-Z_5-Z_6-Z_7-$, and $V_8$: $-Z_3-Z_4-Z_5-Z_6-Z_7-Z_8-$; $Z_2$ to $Z_8$ each represents

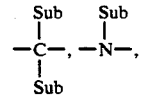

—O—, —S— or $-SO_2-$; and Sub represents a simple bond, a hydrogen atom or a substituent; provided that plural Sub groups may be the same of different and may be linked to form a 3-membered to 8-membered saturated or unsaturated carbon ring or heterocyclic ring.

33. A heat-developable light-sensitive material as claimed in claim 32, wherein the group represented by EAG is an aryl group or a heterocyclic group each being substituted with at least one electron attractive group.

34. A heat-developable light-sensitive material as claimed in claim 31, wherein Time represents a group capable of releasing Dye through a subsequent reaction, with the cleavage of a nitrogen-oxygen bond, a nitrogen-nitrogen bond or a nitrogen-sulfur bond as a trigger.

35. A heat-developable light-sensitive material as claimed in claim 31, wherein the group represented by EAG contains a ballast group having at least 8 carbon atoms.

36. A heat-developable light-sensitive material as claimed in claim 1, wherein the electron donor or precursor thereof is a compound represented by the following general formula (C) or (D):

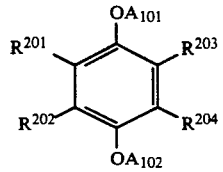

(C)

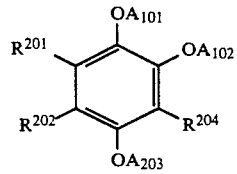

(D)

wherein $A_{101}$ and $A_{102}$, which may be the same or different, each represents a hydrogen atom or a protective group for a phenolic hydroxyl group, which is capable of being removed upon a nucleophilic reagent, or $A_{101}$ or $A_{102}$ combines with $R^{201}$, $R^{202}$, $R^{203}$ or $R^{204}$ to form a ring; and $R^{201}$, $R^{202}$, $R^{203}$ and $R^{204}$, which may be the same or different, each represents a hydrogen atom, an alkyl group, an aryl group, an alkylthio group, an arylthio group, a sulfonyl group, a sulfo group, a halogen atom, a cyano group, a carbamoyl group, a sulfamoyl group, an amido group, an imido group, a carboxyl group, or a sulfonamido group, provided that the total number of carbon atoms included in $R^{201}$ to $R^{204}$ is at least 8, or $R^{201}$ and $R^{202}$ and/Or $R^{203}$ and $R^{204}$ in the general formula (C), or $R^{201}$ and $R^{202}$, $R^{202}$ and $R^{203}$ and/or $R^{203}$ and $R^{204}$ in the general formula (D) combine each other to form a saturated or unsaturated ring.

37. A heat-developable light-sensitive material as claimed in claim 36, wherein at least one of $R^{201}$ and $R^{202}$ at least one of $R^{203}$ and $R^{204}$ are the substituents other than hydrogen atoms.

38. A heat-developable light-sensitive material as claimed in claim 1, wherein the electron transfer agent is a compound represented by the following general formula (X-I) or (X-II):

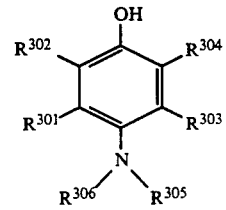

(X-I)

-continued (X-II)

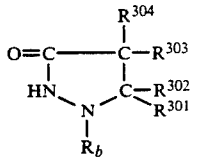

wherein $R_b$ represents an aryl group; and $R^{301}$, $R^{302}$, $R^{303}$, $R^{304}$, $R^{305}$ and $R^{306}$, which may be the same or different, each represents a hydrogen atom, a halogen atom, an acylamino group, an alkoxy group, an alkylthio group, an alkyl group or an aryl group.

39. A heat-developable light-sensitive material as claimed in claim 38, wherein the electron transfer agent is a compound represented by the general formula (X-II).

40. A heat-developable light-sensitive material as claimed in claim 39, wherein $R^{303}$ and $R^{304}$ each represents a hydrogen atom, an alkyl group having from 1 to 10 carbon atoms, a substituted alkyl group having from 1 to 10 carbon atoms or a substituted or unsubstituted aryl group.

41. A heat-developable light-sensitive material as claimed in claim 39, wherein $R^{303}$ and $R^{304}$ each represents a hydrogen atom, a methyl group, a hydroxymethyl group, a phenyl group or a phenyl group substituted with a hydrophilic group.

42. A heat-developable light-sensitive material as claimed in claim 1, wherein the heat-developable light-sensitive material comprises at least one light-sensitive layer containing the surface latent image type silver halide, the binder, the electron transfer agent or precursor thereof, the electron donor or precursor thereof, the reducible dye providing compound and the hydrazine derivative.

43. A heat-developable light-sensitive material as claimed in claim 42, wherein the heat-developable light-sensitive material comprises at least three light-sensitive layers each having sensitivity in a different spectral range.

* * * * *